US005815173A

United States Patent [19]

Silverbrook

[11] Patent Number: 5,815,173

[45] **Date of Patent: *Sep. 29, 1998**

[54] NOZZLE STRUCTURES FOR BUBBLEJET PRINT DEVICES

[75] Inventor: Kia Silverbrook, Wollahra, Australia

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 115,128

[22] Filed: Sep. 1, 1993

Related U.S. Application Data

[63] Continuation-in-part of Ser. No. 31,919, Mar. 16, 1993, abandoned, which is a continuation of Ser. No. 827,985, Jan. 29, 1992, abandoned.

[30] Foreign Application Priority Data

| | | | |
|---|---|---|---|
| Jan. 30, 1991 | [AU] | Australia | PK4374 |
| Feb. 22, 1991 | [AU] | Australia | PF4731 |
| Feb. 22, 1991 | [AU] | Australia | PF4732 |
| Feb. 22, 1991 | [AU] | Australia | PF4733 |
| Feb. 22, 1991 | [AU] | Australia | PF4734 |
| Feb. 22, 1991 | [AU] | Australia | PF4735 |
| Feb. 22, 1991 | [AU] | Australia | PF4736 |
| Feb. 22, 1991 | [AU] | Australia | PF4737 |
| Feb. 22, 1991 | [AU] | Australia | PF4738 |
| Feb. 22, 1991 | [AU] | Australia | PF4739 |
| Feb. 22, 1991 | [AU] | Australia | PF4740 |
| Feb. 22, 1991 | [AU] | Australia | PF4741 |
| Feb. 22, 1991 | [AU] | Australia | PF4742 |
| Feb. 22, 1991 | [AU] | Australia | PF4743 |
| Feb. 22, 1991 | [AU] | Australia | PF4744 |
| Feb. 22, 1991 | [AU] | Australia | PF4745 |
| Feb. 22, 1991 | [AU] | Australia | PF4746 |
| Dec. 23, 1991 | [AU] | Australia | 89996/91 |

[51] Int. Cl.[6] ..... B41J 2/205; B41J 2/145; B41J 2/05

[52] U.S. Cl. ..... 347/15; 347/47; 347/59

[58] Field of Search ..... 347/40, 41, 43, 347/42, 15, 47, 59, 65

[56] References Cited

U.S. PATENT DOCUMENTS

| | | | |
|---|---|---|---|
| 4,374,388 | 2/1983 | Heinzl | 347/15 |
| 4,413,275 | 11/1983 | Horiuchi | 347/43 X |
| 4,429,321 | 1/1984 | Matsumoto | 347/59 |
| 4,490,728 | 12/1984 | Vaught et al. | 347/63 |
| 4,680,596 | 7/1987 | Logan | 347/15 |
| 4,809,016 | 2/1989 | Padalino | 347/74 |
| 4,855,752 | 8/1989 | Bergstedt | 347/43 |
| 4,889,587 | 12/1989 | Komuro | 347/62 X |
| 4,914,562 | 4/1990 | Abe | 347/63 |
| 4,963,882 | 10/1990 | Hickman | 347/41 |
| 4,967,203 | 10/1990 | Doan | 347/43 X |

FOREIGN PATENT DOCUMENTS

| | | | |
|---|---|---|---|
| 0244214 | 11/1987 | European Pat. Off. . | |
| 0321075 | 6/1989 | European Pat. Off. . | |
| 0352726 | 1/1990 | European Pat. Off. . | |
| 0382423 | 8/1990 | European Pat. Off. . | |
| 355133181 | 10/1980 | Japan | H04N 1/22 |
| 124865 | 7/1984 | Japan . | |
| 60-018359 | 1/1985 | Japan . | |
| 104335 | 6/1985 | Japan . | |
| 61-106270 | 5/1986 | Japan . | |
| 152865 | 7/1987 | Japan . | |
| 63-191644 | 9/1988 | Japan . | |
| 1186700 | 7/1989 | Japan . | |
| 1259957 | 10/1989 | Japan . | |

*Primary Examiner*—Joseph W. Hartary
*Attorney, Agent, or Firm*—Fitzpatrick, Cella, Harper & Scinto

[57] ABSTRACT

An ink jet print head includes a substrate and a plurality of nozzles provided on the substrate for ejecting ink. The plurality of nozzles are arranged in two dimensions on the substrate such that a shortest distance between adjacent nozzles in at least one dimension is shorter than a pixel pitch.

31 Claims, 27 Drawing Sheets

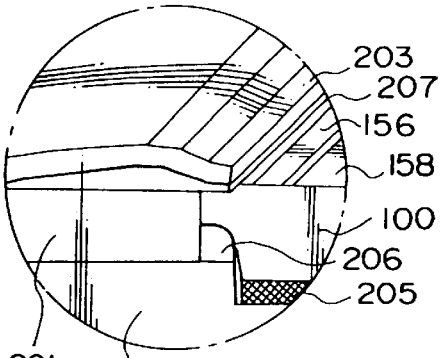
FIG. 23B
FIG. 23A
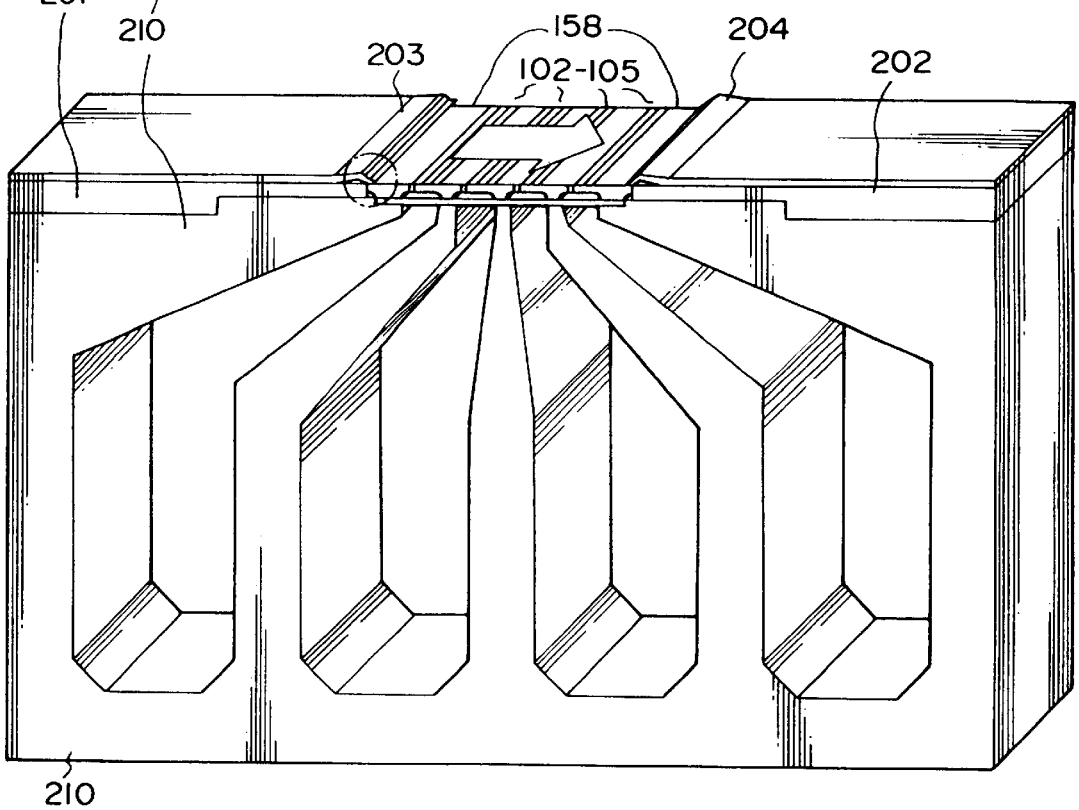
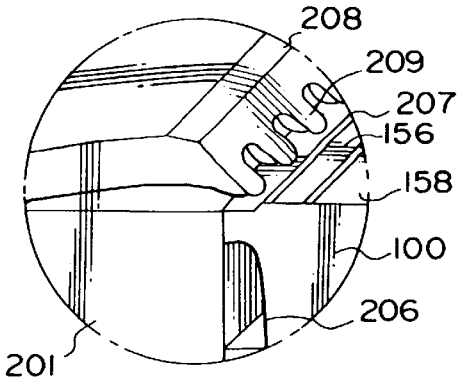
FIG. 24

NOZZLE STRUCTURES FOR BUBBLEJET PRINT DEVICES

This application is a continuation-in-part of application Ser. No. 08/031,919 filed Mar. 16, 1993, now abandoned, which is a continuation of application Ser. No. 07/827,985 filed Jan. 29, 1992, now abandoned.

BACKGROUND OF THE INVENTION

1. Field of the Invention

The present invention relates to ink jet printing and in particular, discloses a semiconductor bubblejet print head.

2. Description of the Related Art

Bubblejet print heads are known in the art and have recently become available commercially as portable, relatively low-cost printers generally used with personal computers. Examples of such devices are those made by HEWLETT-PACKARD as well as the CANON BJ10 printer.

FIGS. 1 and 2 show schematic perspective views of prior art bubblejet print heads representative of those used by CANON and HEWLETT-PACKARD, respectively.

As seen in FIG. 1 the prior art bubblejet (BJ) head 1 is formed by a BJ semiconductor chip device 2 abutting a laser etched cap 3. In this configuration, the cap 3 acts as a guide for the inward flow of ink (indicated in the drawing by arrows), into the head 1 via an inlet 4, and the outward ejection of the ink from the head 1 via a plurality of nozzles 5. The nozzles 5 are formed as the open ends of channels in the cap 3. Upon the BJ chip 2 are arranged one or more (generally 64) heater elements (not shown) which are energised so as to cause ink to be ejected from each of the nozzles 5 by a bubble of vapourised ink formed within the corresponding channel. The BJ chip also includes a semiconductor diode matrix (not illustrated) which acts to supply energy to the heater elements arranged adjacent the channels.

In the prior art HEWLETT-PACKARD thermal ink jet head 10 as seen in FIG. 2, a two part configuration is also used, however ink enters the cap 12 through an inlet 13 arranged in the side of the cap 12 which supplies an array of nozzles 14 arranged perpendicular to the inlet 13. Ink exits through the face of the cap 12. A flat heater 15 is arranged immediately beneath each nozzle 14 so as to cause ejection of ink from the inlet channel 13 into the nozzles.

However, problems exist with these prior art devices due to their two-part construction in creating accurate registration between the two parts. Even if accurate registration could be initially achieved, differing rates of thermal expansion or contraction would prevent this accuracy from being maintained over appreciable dimensions. Such registration problems limit performance of the prior art devices for image densities generally lower than 400 dots per inch (dpi), and for scanning or moving print heads rather than fixed print heads.

There are some examples, for instance, U.S. Pat. No. 4,855,752 and U.S. Pat. No. 4,963,882, in which a head of the type disclosed in FIGS. 1 or 2 is applied, and each of which discloses a head having nozzle disposed in a two dimensional manner. However, all of the examples only disclose that the head is used for printing a binary (non-gradated) image, but these references do not disclose a head for printing a multi-tone image by ejecting a plurality of ink droplets for each pixel.

SUMMARY OF THE INVENTION

It is an object of the present invention to substantially overcome, or ameliorate, the above mentioned problems through the provision of an alternative bubblejet print head configuration.

The present invention relates to bubblejet print technology and decals with one or more of the following aspects.

An object of the invention is to provide a head for printing a multi-tone image by ejecting a plurality of ink droplets per single pixel, and a printing method using the head.

Another object of the invention is to provide a multi-tone printing head which is not only compact, but also maintains mechanical strength, and a multi-tone printing method using the head.

According to one aspect of the present invention, an ink jet print head includes a substrate and a plurality of nozzles provided on the substrate for ejecting ink. The plurality of nozzles are arranged in two-dimensions on the substrate such that a shortest distance between adjacent nozzles in at least one dimension is shorter than a pixel pitch.

According to another aspect of the present invention, an ink jet print head includes a substrate and a plurality of nozzles provided on the substrate for ejecting ink, wherein $0<P_X$, $P_Y$ and $P_X<P_I$ or $P_Y<P_I$. $P_X$ represents a shortest distance between adjacent nozzles in a first direction, $P_Y$ represents a shortest distance between adjacent nozzles in a second direction perpendicular to the first direction, and $P_I$ represents a pixel pitch.

According to a further aspect of the present invention, a method for printing on a printing medium by using an ink jet head includes the steps of providing an ink jet head having (i) a substrate, and (ii) a plurality of nozzles provided on the substrate for ejecting ink; ejecting ink sequentially from each of the plurality of nozzles by time share driving the plurality of nozzles; and moving the printing medium and the ink jet print head relative to each other during the ejecting step. In the providing step, the plurality of nozzles are arranged two-dimensionally on the substrate such that a shortest distance between adjacent nozzles in at least one dimension is shorter than a pixel pitch.

According to yet another aspect of the present invention, a method for printing on a printing medium by using an ink jet head includes the steps of providing an ink jet head having (i) a substrate, and (ii) a plurality of nozzles provided on the substrate for ejecting ink; ejecting ink sequentially from each of the plurality of nozzles by time share driving the plurality of nozzles; and moving the printing medium and the ink jet print head relative to each other during the ejecting step. For the plurality of nozzles provided in the providing step:

$0<P_X$, $P_Y$ and $P_X<P_I$ or $P_Y<P_I$.

$P_X$ represents a shortest distance between adjacent nozzles in a first direction, $P_Y$ represents a shortest distance between adjacent nozzles in a second direction perpendicular to the first direction, and $P_I$ represents a pixel pitch. The above and other objects, effects, features and advantages of the present invention will become more apparent from the following description of embodiments thereof taken in conjunction with the accompanying drawings.

BRIEF DESCRIPTION OF THE DRAWINGS

A number of preferred embodiments of the present invention will now be described with reference to the drawings in which:

FIGS. 23A, 23B and 24 show two methods of connecting power to the ZBJ chip;

Table 1 lists details of ZBJ chips for various applications; and

Table 2 lists various fault conditions and their consequence.

DETAILED DESCRIPTION OF THE PREFERRED EMBODIMENT

Figure 1:
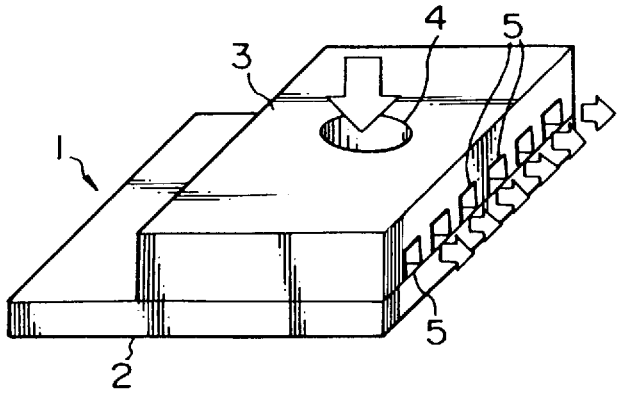
FIG. 1 (PRIOR ART)
FIGS. 1 and 2 are representations of prior art BJ print heads.
Figure 2:
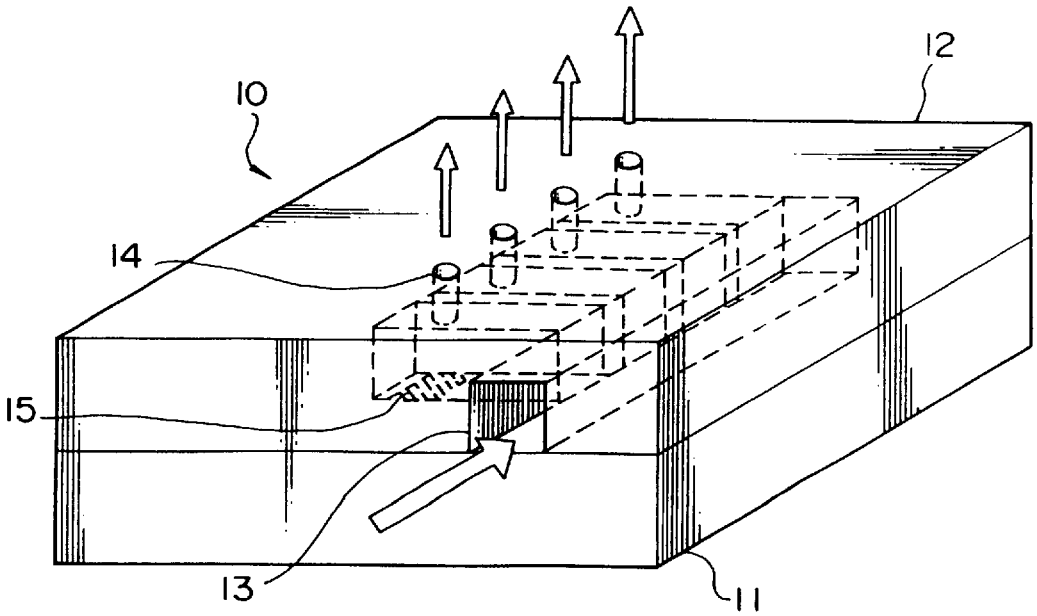
FIG. 2 (PRIOR ART)
Figure 3:
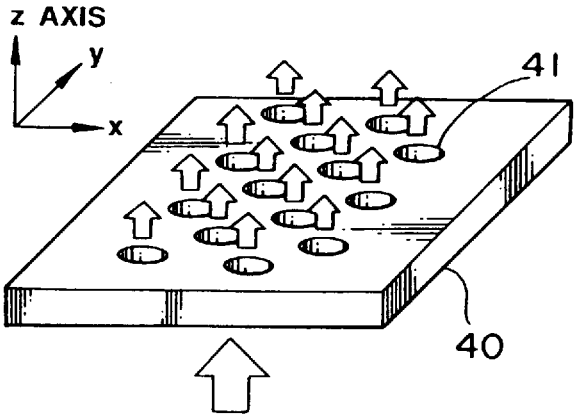
FIG. 3 is a representation of a ZBJ chip of the present invention.

Referring firstly to FIG. 3, the general configuration of a Z-axis bubblejet (ZBJ) chip 40 is shown which includes an ink inlet arranged on one (underside as illustrated) plane surface of the chip 40 and a plurality of nozzles 11 which provide for outlets of ink on the opposite side. It is readily apparent from a direct comparison of FIGS. 1 and 2 with FIG. 3 that in the ZBJ chip 40, is provided as a single, monolithic, integrally formed structure as opposed to the two part structure of the prior art. The chip 40 is formed using semiconductor fabrication techniques. Furthermore, ink is ejected from the nozzles 41 in the same direction that ink is supplied to the chip 40.

Figure 4B:
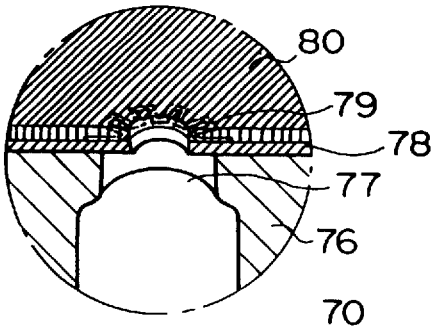
FIGS. 4A and 4B are cut-away isometric views of a first embodiment of a ZBJ print head.
Figure 4A:
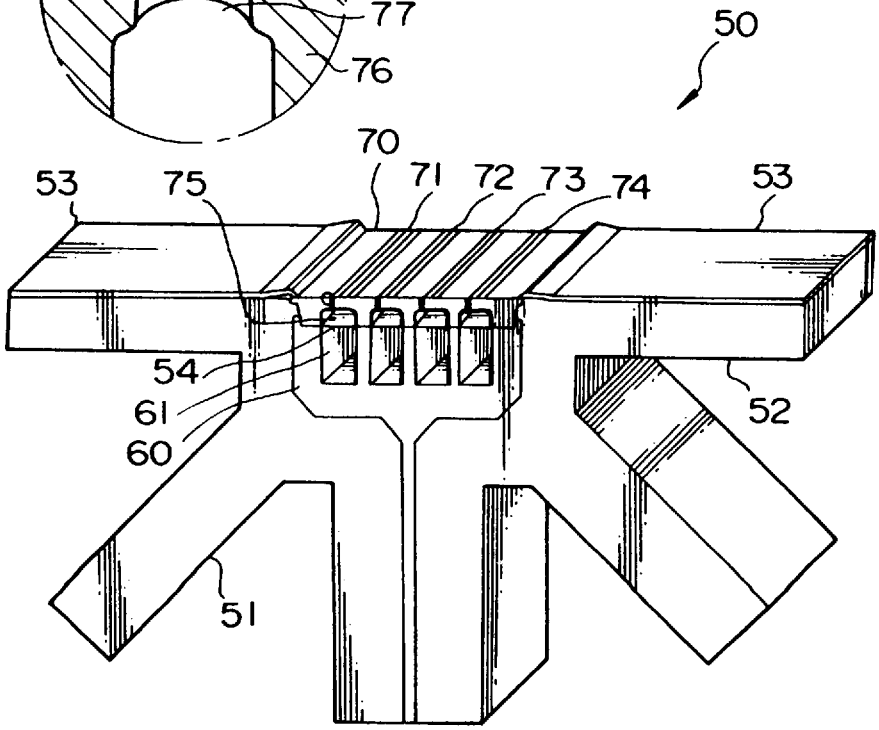

Referring now to FIGS. 4A and 4B, a cross-section of a first embodiment of a stationary (i.e. non-moving) ZBJ printhead 50 is shown which is configured for the production of full length A4 continuous tone colour images at an image density of 1600 dpi or 400 pixels per inch. The head 50 is provided with a ZBJ chip 70 having four nozzle arrays, one for each of cyan 71, magenta 72, yellow 73 and black 74. The nozzle arrays 71–74 are formed from nozzle vias 77 with four nozzles per pixel giving a total of 51,200 nozzles per chip 70. The magnified portion of FIG. 4B shows the basic nozzle cross-section which is formed in a silicon substrate 76 over which a layer 78 of thermal $SiO_2$ is formed. A heater element 79 is provided about the nozzle 77 which is capped by an overcoat layer 80 of chemical vapour deposited (CVD) glass. Each of the nozzles 77 communicates to a common ink supply channel 75 for that particular colour of ink. The ZBJ chip 70 is positionable upon a channel extrusion 70 which has ink channels 61 communicating with the channels 75 so as to provide for a continuous flow of ink to the chip 70. A membrane filter 54 is provided between the extrusion 60 and the chip 70.

Two power bus bars 51 and 52 are provided which electrically connect to the chip 70. The bus bars 51 and 52 also act as heat sinks for the dissipation of heat from the chip 70.

Figure 5B:
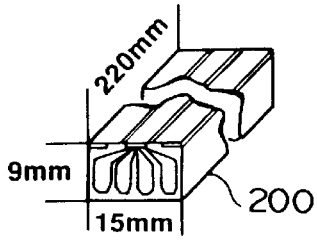
FIGS. 5A and 5B are views similar to FIGS. 4A and 4B but of a second embodiment.
Figure 5A:
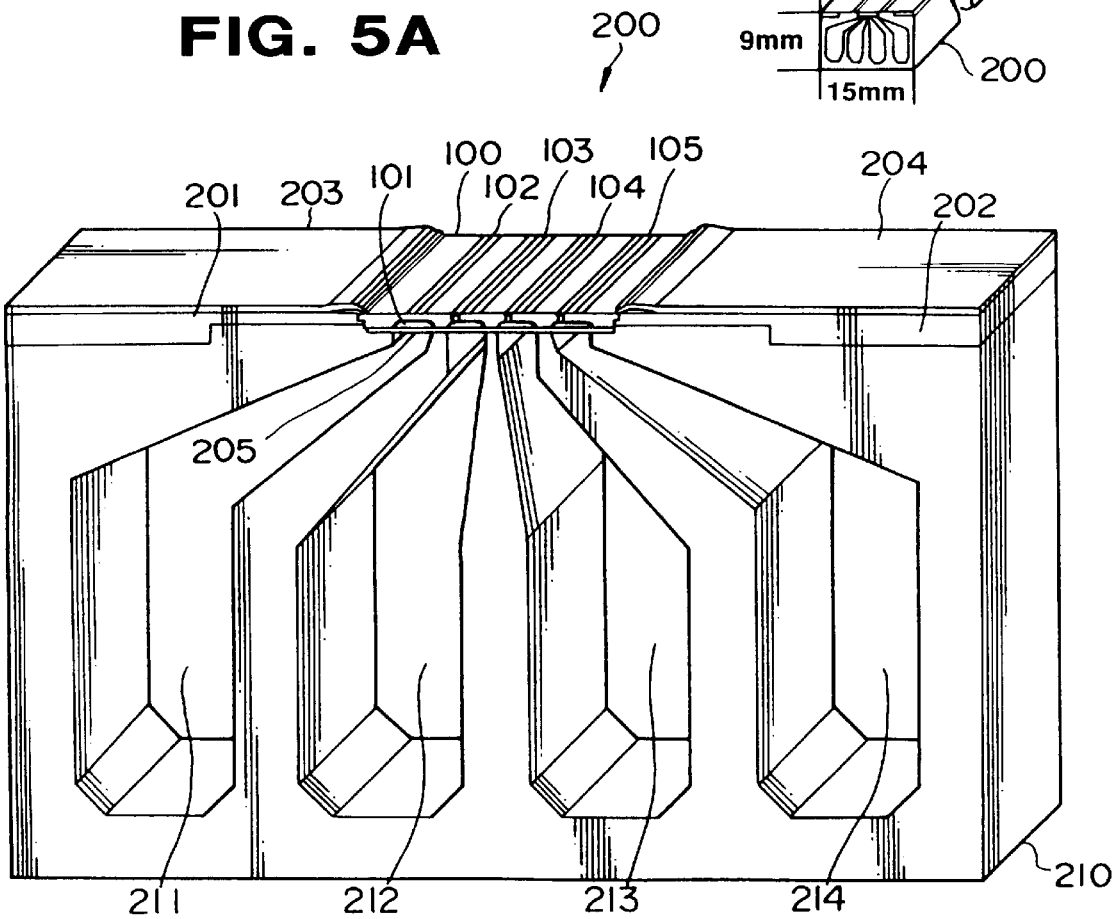

FIGS. 5A and 5B show a second embodiment of a ZBJ head 200 similar in configuration to that shown in FIG. 4.

The head 200 has a ZBJ chip 100 including nozzle arrays 102, 103, 104 and 105 for each of cyan, magenta, yellow and black respectively. The chip 100 has ink channels 101 which communicate with ink reservoirs 211, 212, 213 and 214, respectively for the above colours, in a channel extrusion 210.

The channel extrusion 210 has an alternate geometry of a higher volumetric capacity than that shown in FIGS. 4A and 4B for the same size of the chip 100. Also illustrated are tab connections 203 and 204 which connect the power bus bars 201 and 202 to the chip 100. A membrane filter 205 is also provided as before.

So as to be able to print an A4 page, the head 200 is required to be about 220 mm long, by 15 mm across, by 9 mm deep. Using the foregoing as a standard arrangement, many configurations of ZBJ heads are possible. The actual size and the number of nozzles per chip depends solely on the required performance of the printer application.

Table 1 lists seven applications of ZBJ printheads and the various corresponding requirements for each application. Application one is considered suitable for low cost full colour printers, portable computers, low cost colour copiers and electronic still photography. Application two is considered suitable for personal printers, and personal computers, and application three is useful in electronic still photography, video printers and workstation printers. The fourth application finds use in colour copiers, full colour printers, colour desktop publishing and colour facsimiles. The fifth application is used for a monochrome device which sees application in digital black and whites copiers, high resolution printers, portable computers, and plain paper facsimiles. Applications six and seven show respectively high speed and medium speed A3 continuous tone applications useful in colour copiers and colour desktop publishing. The high speed version of application six finds use in small run commercial printing and the medium speed version in colour facsimiles.

It will be appreciated by those skilled in the art that the foregoing applications are configured for ZBJ heads with a drop size of 3 pl (pico-litres). Other configurations are possible and higher operating speeds can be achieved at the expense of image quality, by using larger drop sizes.

Figure 6:
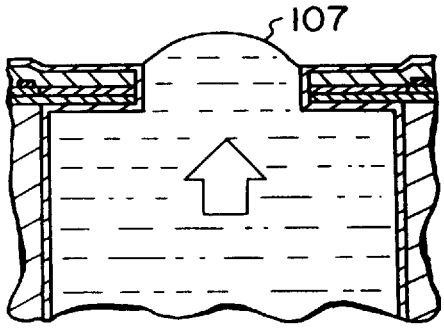
FIGS. 6 and 7 show the manner of expulsion of ink from one nozzle of the ZBJ chip.
Figure 7:
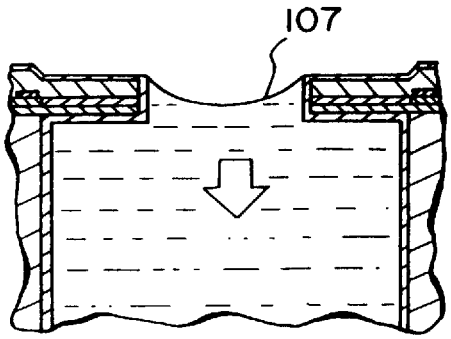

The operation of the ZBJ chip 100 differs from that of prior art bubblejet heads through the use of an alternate drop ejection mechanism which is in part illustrated in FIGS. 6 and 7. A single nozzle of the ZBJ print head is in its quiescent state where the heater is off. Ink within the nozzle forms a meniscus 107.

The heater is turned on thus heating the surrounding substrate and thermal layer which in turn heats the ink within the nozzle. Some of the ink evaporates to form small bubbles.

As the evaporated ink is heated, it expands and coalesces into large bubbles.

Pressure from the expanding gas bubbles forces ink out of the nozzle tip at high speed.

The heater is turned off which acts to contract the bubble and draw ink from the drop that is formed.

The drop separates from the ink within the nozzle and the contracting bubble draws an ink meniscus backwards into the nozzle.

As seen in FIG. 6, surface tension causes the nozzle 110 to refill with ink from the underlying reservoir and in which the velocity of ink causes overfilling.

Finally in FIG. 7, the ink oscillates, and eventually returns to the quiescent state. The oscillating damping time is one factor which determines the maximum dot repetition rate.

Figure 8A:
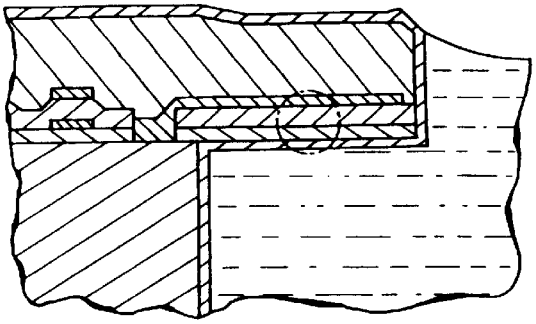
FIGS. 8A, 8B, 9A, 9B, 10A, 10B, 11 and 12 illustrate the transfer of heat about the ZBJ chip.
Figure 8B:
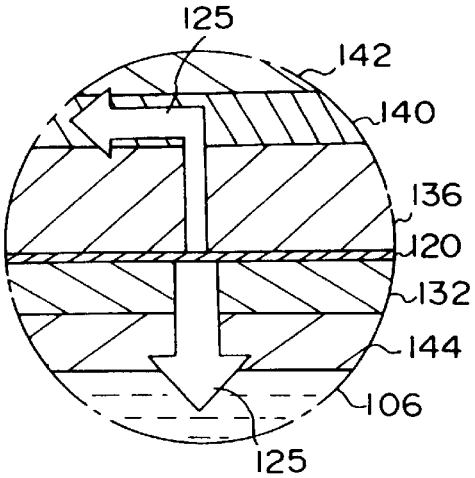

As depicted in FIGS. 8A and 8B, when the heater 120 is turned on, a portion of the heat will flow into the ink 106, and the remainder flows into the material surrounding the nozzle in the manner indicated.

Figure 9A:
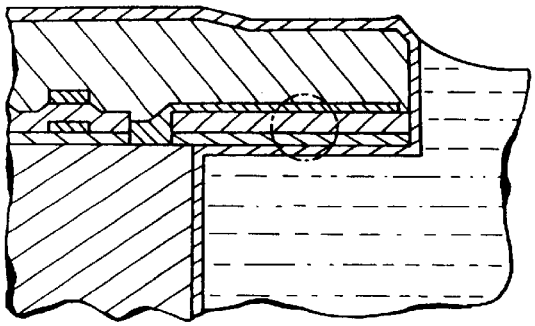
Figure 9B:
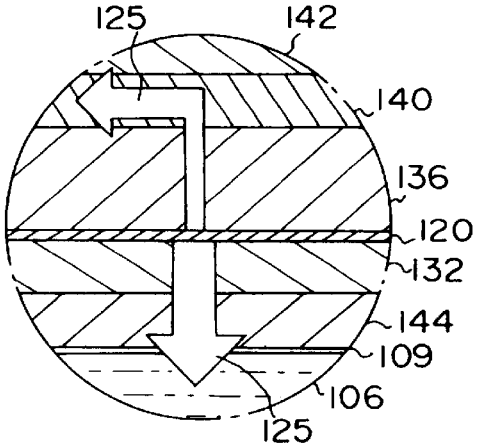

FIGS. 9A and 9B illustrate the super heating of ink in which a thin layer of superheated ink 109 forms adjacent the passivation layer 144 with the nozzle cavity 112.

Excess heat must be rapidly removed after the heater 120 is turned off. Within 200 microseconds of the heater 120 being energized, there should be no ink 106 remaining at a temperature above 100° C., at which bubbles 116 form due to the ink 106 being substantially composed of water. If this is not achieved, the next ink drop 108 will not fire correctly as there will be an insulating layer of vapour between the heater 120 and the ink 106.

The waste heat is removed by three separate paths. Firstly, heat is removed through the ink which acts to raise its temperature slightly. However, the thermal conductivity of ink is low, so the amount of heat removed by this path is also low.

Because the walls of the nozzle 110 are made of silicon from the substrate 130, and have high thermal conductivity, heat dissipation through the walls is fast. However, not all of the bubble 116 will be in contact with the side walls of the nozzle 110.

Figure 10A:
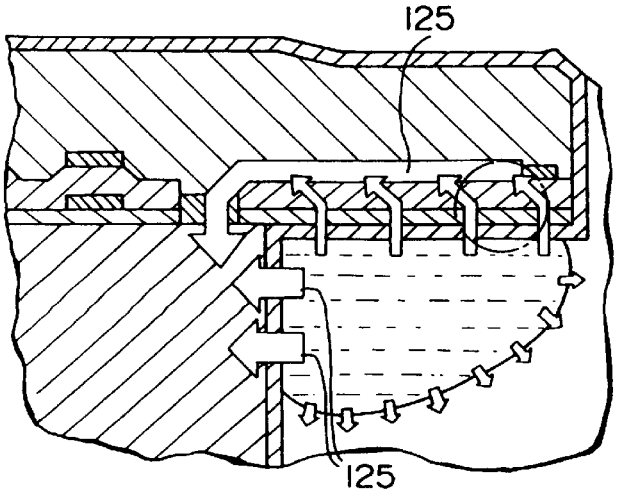
Figure 10B:
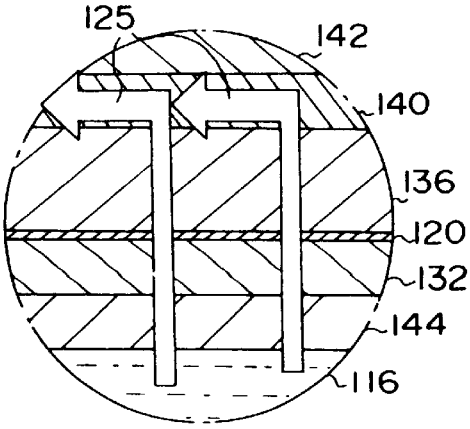

Also, waste heat is removed through the heater element 120. Heat dissipation through the heater element 120 is important, as no ink vapour must be in contact with the heater 120 when the next drop is fired. Because the bulk of material around the heater 120 is glass, with low thermal conductivity, the thermal shunt 140 is included, to shunt waste heat to the substrate 130. If the removal of this heat can be achieved within approximately 200 microseconds, then it is not necessary to include the thermal shunt 140. Figs. 10A and 10B illustrate the heat flow from the cooling bubble 116 as described above.

Figure 11:
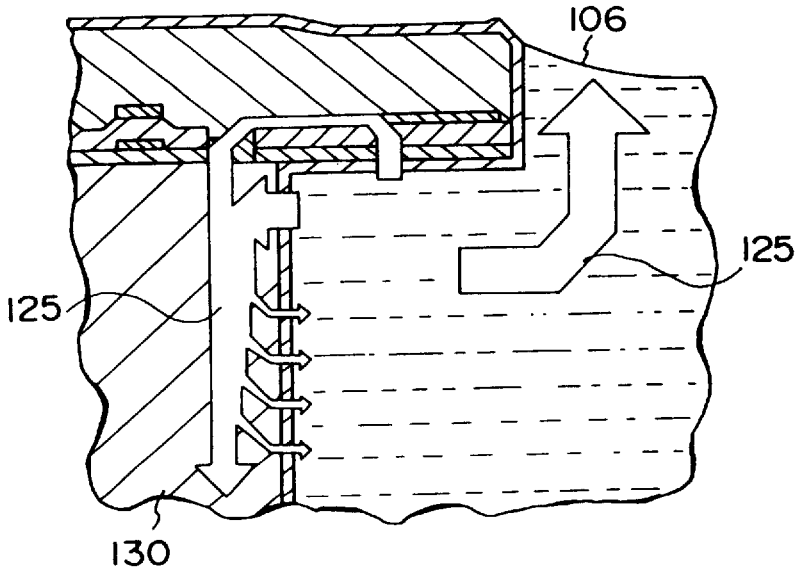

FIG. 11 also shows waste heat removal paths 125 in which heat will flow through the substrate 130 as the main thermal conduit away from the heater 120. Some of this heat will flow back into the ink 106 and eventually be ejected with subsequent drops 108. The remainder of the heat will flow through the substrate 130 and into the aluminum heat sink (51,52), seen in FIGS. 4A and 4B.

Figure 12:
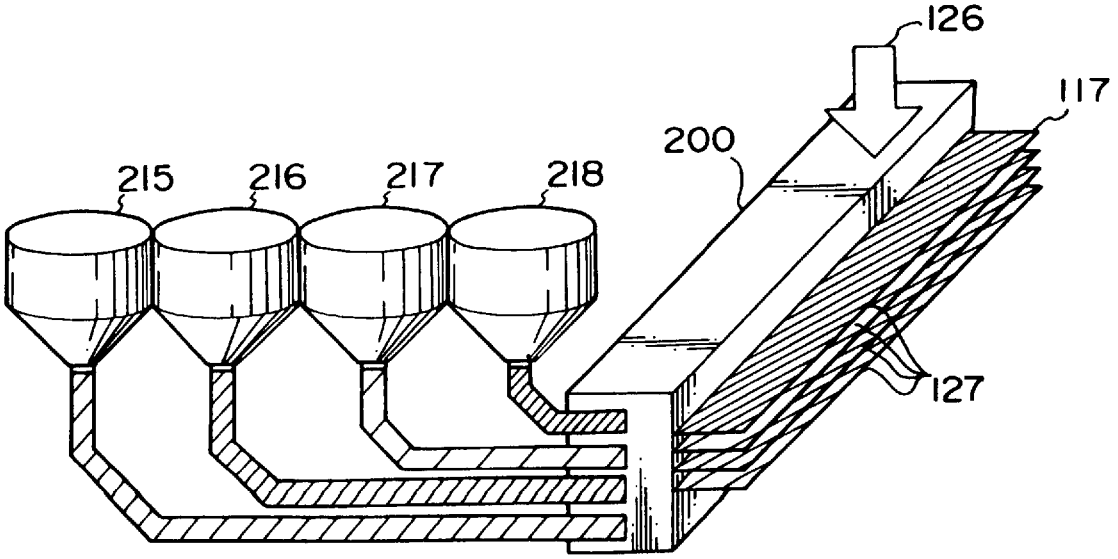

FIG. 12 illustrates the macroscopic heat dissipation for the ZBJ head 200 with 51,200 nozzles printing four colours. If the heater action does not raise the average temperature of the entire head assembly 200 more than about 10° C. to 20° C. above that of the incoming ink 106, it is not necessary to provide an external cooling mechanism. In this manner, the ZBJ head 200 can be effectively cooled by a steady flow of ink 106 from ink reservoirs 215, 216, 217 and 218 as illustrated. The quantity of ink flow is in direct proportion to the heat generated, as ink 106 is expelled every time the heaters are turned on.

Generally, about 50 watts of electrical power 126 is supplied to the head 200 which outputs a spray 117 of 12,800 drops per colour per 200 $\mu$s use. This represents an output 127 of about 1.28 ml of ink drops per second at ambient temperature plus 10°–20° C. It should also be noted that the driver circuit on the chip 100 also dissipates some power but this is minor compared to that dissipated by the heaters 120 themselves.

However, if the nozzle efficiency (thermal and the substantially smaller kinetic output compared with electrical input) is less than that indicated above, more heat will be generated than can be expelled with the drops without raising the ink temperature excessively. In this case, other heat sinking methods (such as forced air cooling or liquid cooling using the ink) can also be used.

While the average temperature of the ZBJ print head 200 is low, the operating temperature of the ZBJ heater elements 120 is above 300° C. It is important that the active elements (drive transistors and logic) of the ZBJ chip 100 do not experience this temperature extreme. This can be achieved by locating the drive transistors and logic as far from the heater elements 120 as possible. These active elements can be located at the edges of the chip 100, leaving only the heaters 120 and the aluminum connecting lines in the high temperature region.

Figure 13:
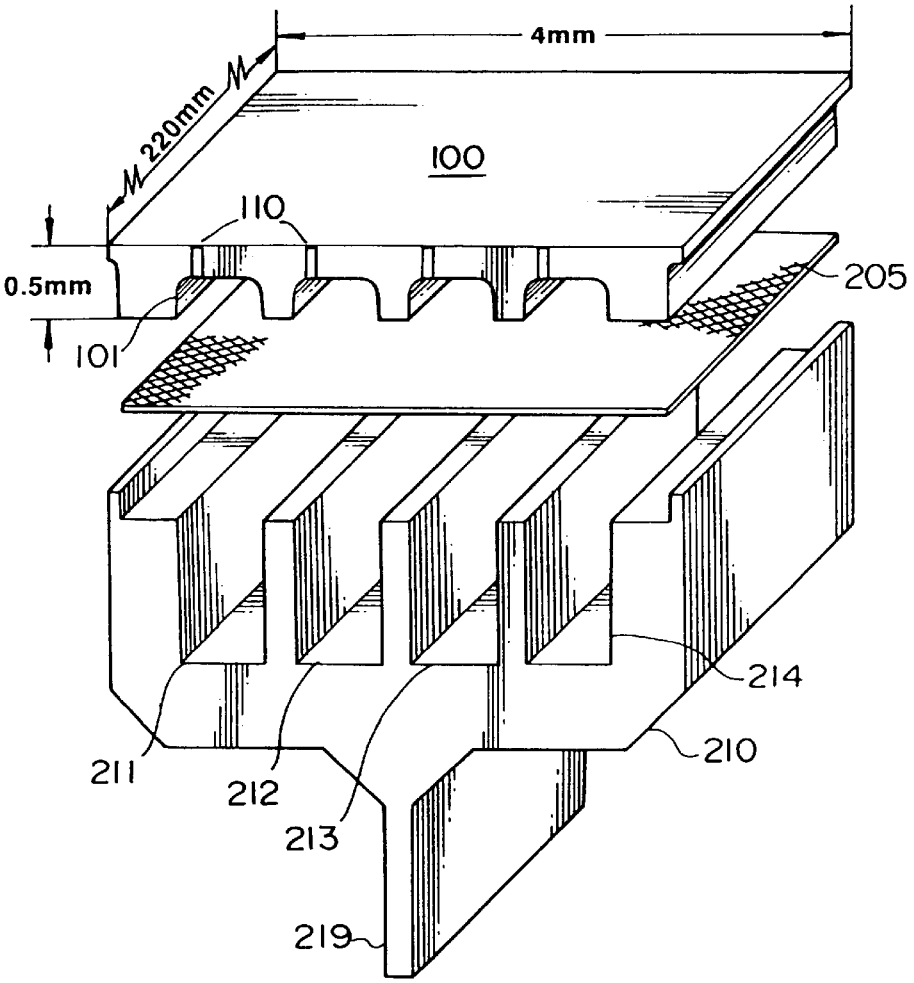
FIGS. 13 and 14 show the configuration of a ZBJ print head including a chip, membrane filter and ink channel extrusion.
Figure 14:
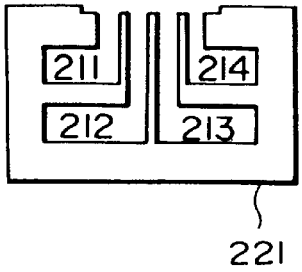

Ink Channel:

As seen in FIGS. 13 and 14, a full colour ZBJ print head 200 has four ink channels, one for each of cyan 211, magenta 212, yellow 213 and black 214. These channels 211–214 are formed as an aluminum extrusion 210 and are filtered and sealed against the back of the ZBJ chip 100.

In some applications, the ink channels 211–214 of FIG. 13 are not sufficient to provide adequate ink flow. In such a situation, the extrusion profile of FIG. 14 can be used so as to increase the volume of flow. As seen in FIG. 13, a 10 micron absolute membrane filter 205 is provided between the ink channel extrusion 210 and the ZBJ chip 100 so as protect against ink contamination. If the membrane filter 205 is compressible, then it can also form as a gasket to prevent ink flow between the four colours. The edges of the head assembly 200 are preferably sealed to prevent gas ingress.

For the above configuration, a manufacturing accuracy of approximately ±50 microns need only be maintained.

Blocked Heads:

Two potential sources of blocked heads exist and these are dried ink and contamination.

When the print head 200 is not in use, the exposed surface will dry out. If it dries too much, the pressure of a bubble 116 will be insufficient to dislodge any dried ink. This problem can be alleviated by:

1. Automatically capping of the head 200 with an air tight seal when not is use;
2. applying a solvent to the front surface of the ZBJ head 200 during a cleaning cycle;
3. The use of a self-skinning ink; and/or
4. A vacuum cleaning system.

Figure 20:
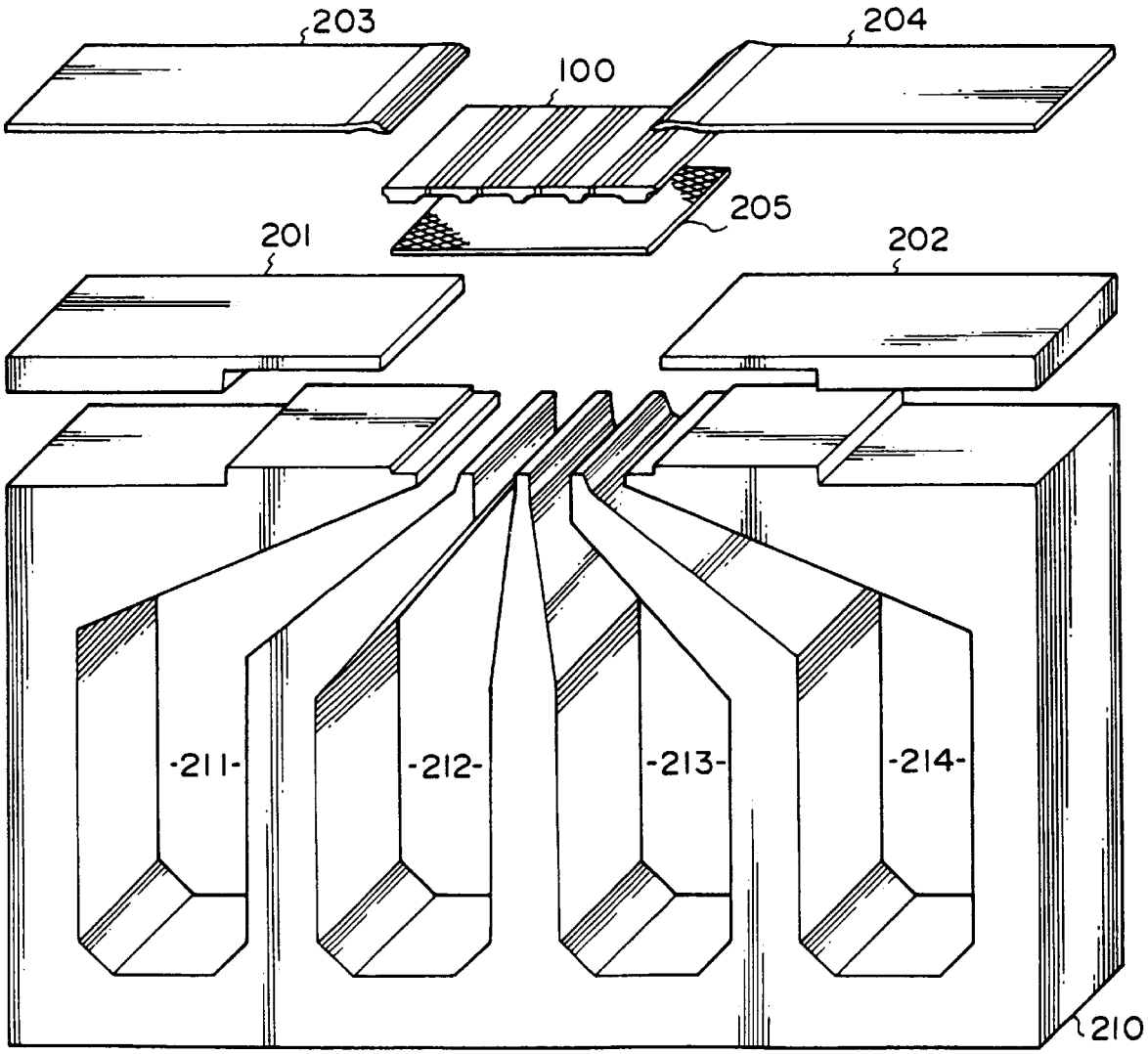
FIG. 20 is an exploded perspective view of a thin section of the full colour ZBJ print head assembly of FIG. 5.

The ZBJ chip 100 is susceptible to blockage by particulate contamination of the ink 106. Any particle of a size between 20 microns and 60 microns will permanently lodge in the nozzle cavity 112, as it cannot be ejected with the ink drop 108. A filter such as the membrane filter 205, is included in the ink path to remove all particles larger than 10 microns. This can bc a 10 micron bonded fibreglass absolute filter and preferably has a relatively large area to allow sufficient ink flow. This is seen in FIGS. 11 and 20.

The continuous tone ZBJ chip 100 with four nozzles 110 per pixel has a degree of tolerance of blocked nozzles 110. A blocked nozzle 110 will result in a 25% reduction of colour intensity for that pixel rather than a complete absence of colour.

Nozzle to Heater Registration:

The existing prior art bubblejet technologies of Canon and Hewlett-Packard's thermal ink jet systems use a two-piece construction to form the nozzles. The heaters are formed on a silicon chip whereas the nozzles are formed using a cap manufactured of a different material. This technique has proven to be highly successful for the production of scanning thermal ink jet heads with moderate numbers of nozzles. However, to achieve full-width A4 printing (i.e. with a stationary head) with very small drop sizes, this technique becomes more difficult. With nozzle pitches of 64 microns and head lengths of 220 mm, differences in thermal expansion between the substrate and the nozzle cap as small as 0.02% are sufficient to cause malfunction. Even small ambient temperature changes will cause this degree of differential thermal expansion if the cap and substrate are made of differing materials. One solution to this problem is to make the cap out of the same material as the substrate, usually silicon. Even if this is done, differences in temperatures between the silicon substrate and the silicon cap (caused by waste heat from the heaters) can be sufficient to cause mis-registration.

The ZBJ chip 100 does not suffer from these problems, as the heaters 120, nozzles 110 and ink paths 101 are all fabricated using a single silicon substrate 130. Nozzle to heater registration is determined by the accuracy of the photolithography with which the ZBJ chip 100 is manufactured. Due to the relatively large feature sizes of this configuration, there is little difficulty in ensuring that the nozzles are correctly aligned as the ZBJ chip 100 is a monolithic chip capable of being manufactured using a 2 micron semiconductor process.

Continuous Tone Images:

As it is difficult to vary the size of drops from a bubblejet head, continuous tone operation is achieved by varying the number of drops.

In the present case, 16 drops per pixel are used to create an image density of 400 pixels per inch. This gives 16 levels of grey tone per pixel. The tonal subtleties required to produce continuous tone images can be produced by standard digital dot or line screening methods or by error diffusion of the least significant 4 bits of an 8 bit colour intensity value. This results in a perceived colour resolution of 256 levels per colour, while maintaining a spacial resolution of 400 pixels per inch. There are two nozzle configuration considered herein: one nozzle per pixel; and four nozzles per pixel. In both cases, the drop size is assumed to be approximately 3 pl.

Figure 15:
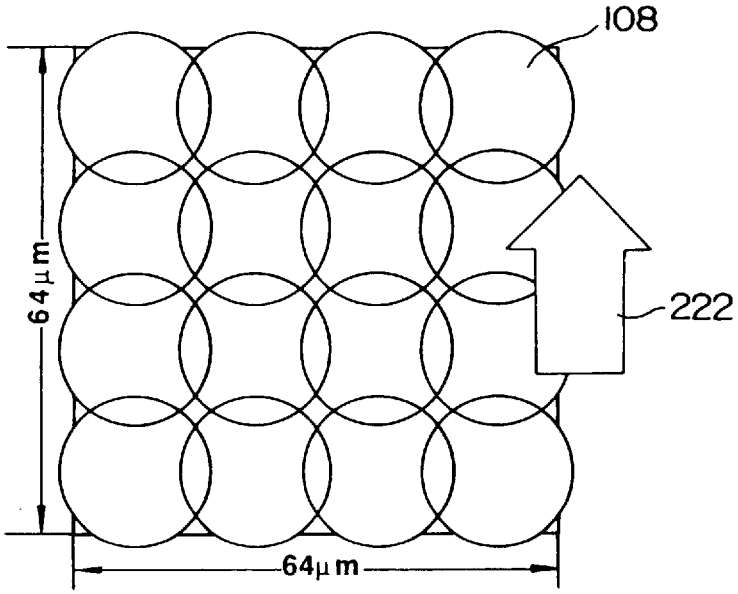
FIGS. 15 and 16 illustrate ink drop positions for a single pixel using a four nozzle per pixel print head and a single nozzle per pixel print head respectively.

FIG. 15 illustrates the ink drop positions for one pixel of a four nozzle per pixel configuration. In this case, the drops are patterned to fill the pixel in a 4×4 array of dimensions 64 mm×64 mm. Horizontal spacing is provided by the spacing between the nozzle 110, and vertical spacing is provided by paper movement. This arrangement provides sufficient linearity in the relationship between the number of drops and the colour intensity. Four nozzles per pixel also allows a print speed four times faster than that of one nozzle per pixel design, with only a slightly larger chip area. The effect of a blocked or defective nozzle is also limited by a reduction in colour by 25%.

Figure 16:
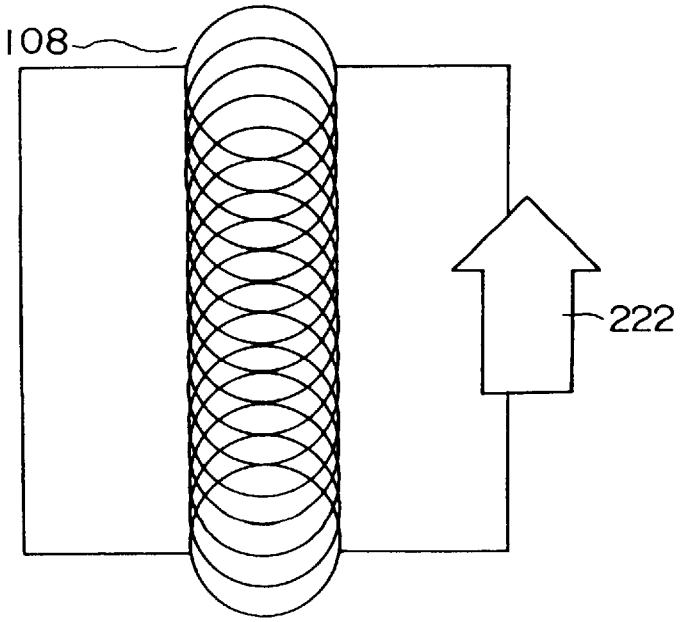

FIG. 16 shows a single nozzle type and the ink drop positions for one pixel. In this case, the vertical drop spacing is provided by paper movement. If sixteen drops are deposited in a 64 micron pixel, drops are spaced at 4 microns. The pixel is filled horizontally by the flow of wet ink from overlapping drops.

This arrangement has the disadvantages of severe non-linearity in the relationship between the number of drops and the colour intensity, and a lower print speed. The advantage is a lower cost of manufacture than that of the four nozzle per pixel embodiment.

Nozzle Configuration:

There are several factors which affect the optimum configuration of the nozzles 110. These include:

(1) For a print resolution of 400 dpi, 64 micron square pixels are required;

(2) The number of nozzles per pixel has a different effect on the nozzle configuration;

(3) The nozzle barrel 113 diameter affects the nozzle layout because the barrel 113 is larger than the diameter of the drop 108. In the preferred embodiment 100, the barrel 113 is 60 microns in diameter. To maintain mechanical strength of the chip 100, it is assumed that each nozzle 110 must be at least about 80 microns from its nearest neighbour;

(4) The firing duty cycle, which is 1:32, allows a 6.25 microsecond heater pulse every 200 microseconds. This gives time for the ink meniscus 107 to stabilise before the next drop 108 is fired;

(5) To prevent major variations in the supply current energizing the heaters 120, all of the 32 available time slots allowed by the 1:32 duty cycle are used by an equal number of nozzles 110. This means that:
current≦number of nozzles×nozzle current/32;

(6) If adjacent nozzles 110 are fired in order, then the heat from one nozzle 110 can interfere with the next, and an area may become too hot. To minimise this problem, widely spaced nozzles 110 are fired in sequence. This is the reason why the firing orders, seen in FIGS. 18 and 19A (to be described) appear to be unnecessarily complex; and (7) The optimum arrangement for a colour head is not simply a monochrome head repeated four times. The extra nozzles of the colour head can be used to achieve better thermal distribution.

Figure 17:
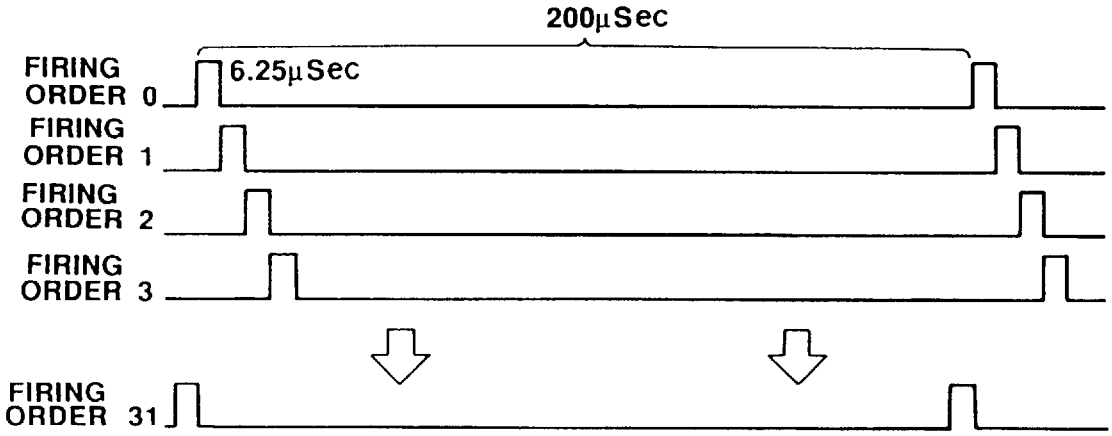
FIG. 17 is a timing chart illustrating nozzle firing order.

FIG. 17 shows the use of a head timing which is divided into 32 different time slots, or "firing orders" each separated by 6.25 microseconds. This produces a repeated cycle of 200 microseconds before the same nozzle is fired again.

Movement of the print medium in the 6.25 microseconds between nozzle firings is equivalent to head placement. The nozzles 110 can readily be skewed to cancel any dot skew caused by paper movement, however this skew will be very small.

Figure 18:
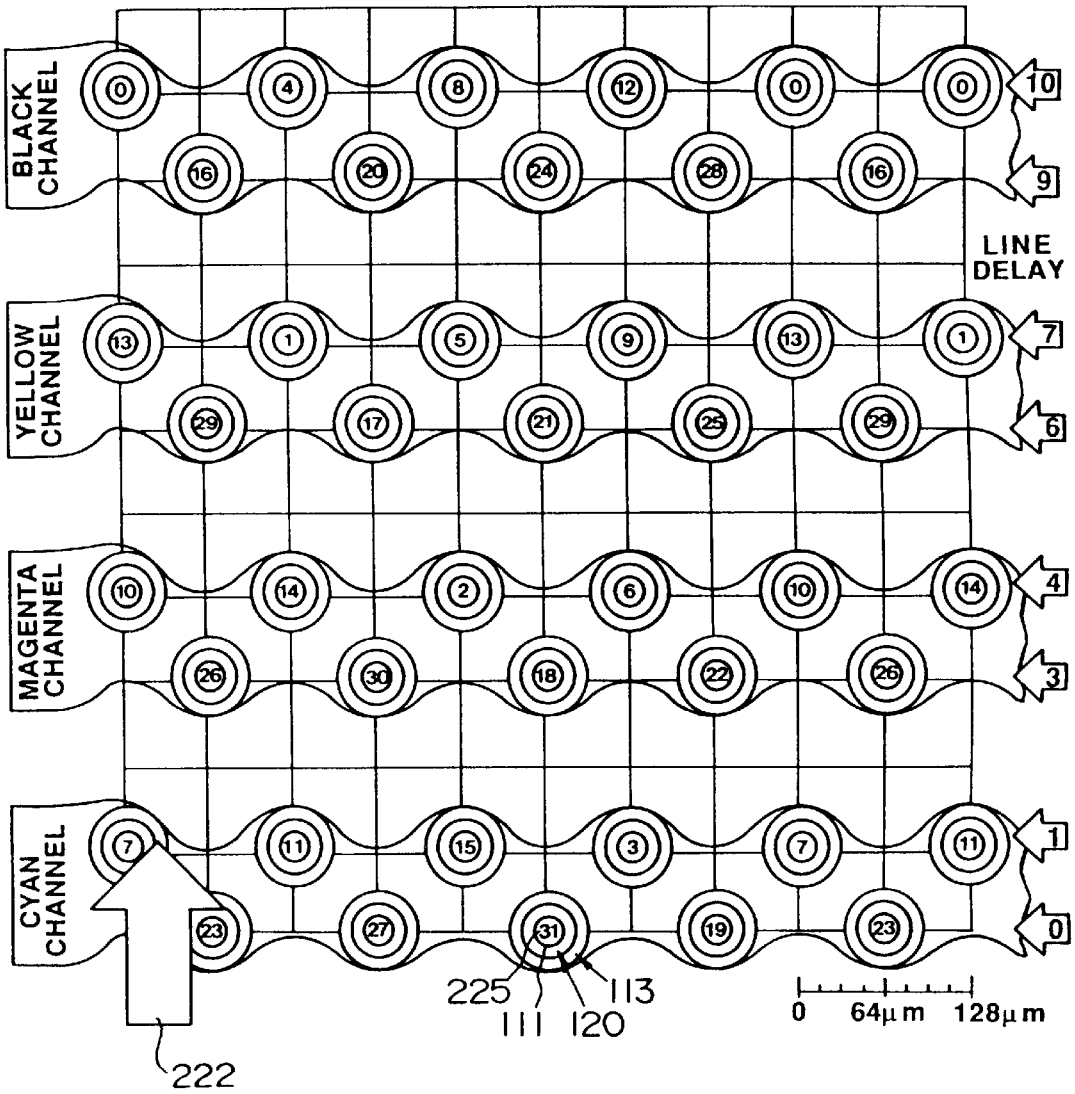
FIG. 18 shows nozzle firing patterns for a one nozzle per pixel colour print head.

Referring any to FIG. 18, this shows a possible nozzle layout for a full colour ZBJ head with one nozzle per pixel and 16 drops per pixel. Horizontal spacing of the nozzles 110 is 1 pixel (64 microns). The nozzles 110 are placed in a zig-zag pattern to maintain spacing of at least about 80 microns between nozzle barrels 113, in order to maintain the mechanical strength of the head. Such a head design can be produced with three micron lithography.

To compensate for the physical displacement of the nozzles 110 from a straight line, line delays must be introduced into the driving circuit. The number of lines delayed is indicated on the right hand side of FIG. 18. The firing order 225 is indicated in the centre of each nozzle 110 and paper movement by the arrow 222.

Figure 19A:
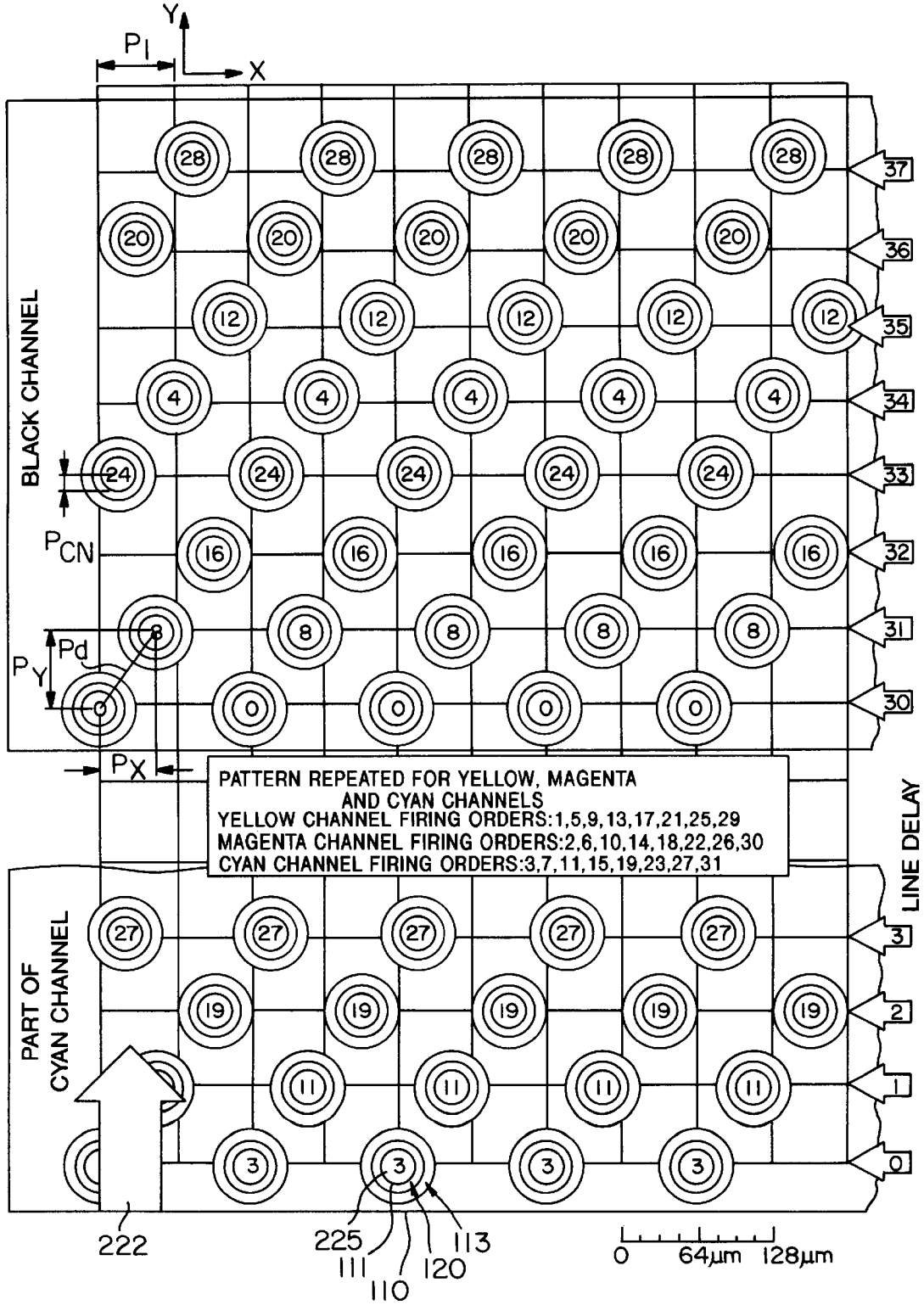
FIGS. 19A, 19B and 19C show nozzle layout configurations.

FIG. 19A shows a nozzle layout for the full colour ZBJ head 200 with four nozzles 110 per pixels. Here, ejection is carried out four times for each nozzle per pixel to give 16 drops per pixel. Horizontal spacing of the nozzles 110 is 16 microns (a quarter of a pixel). The nozzles 110 are arranged in 8 rows in a zig-zag pattern to maintain at least about 80 microns spacing therebetween. The nozzles 110 of the adjacent rows are also positioned (offset from one another) to compensate for any skew caused by paper movement, as indicated by the arrow 222. This head design requires 2 micron lithography for nozzle interconnects and drive circuitry.

The nozzle layout shown in FIG. 19A is explained below in more detail. In FIG. 19A, $P_Y$ represents the shortest distance between adjacent nozzles in a sheet transferring direction Y (as shown with an arrow 222). $P_X$ represents the shortest distance in the direction X perpendicular to the sheet transferring direction Y. $P_I$ represents a pixel pitch.

Because four nozzles per one pixel are arranged in the X direction, a distance in the X direction between nozzle "0" and nozzle "8" is $\frac{3}{4}\cdot P_I$ in FIG. 19A. If an amount ($P_{CN}$) for compensating for deviation due to the transfer of a sheet, as described later, is not taken into consideration, a distance in the Y direction therebetween is equal to $P_I$, because one nozzle per one pixel is arranged in the Y direction. Hence, $PX=\frac{3}{4}\cdot P_I$, and $P_Y=P_I$.

When ejections are performed four times per one nozzle per one pixel by using the ZBJ head 200, a maximum of 16 droplets can be obtained per one pixel. Ejections from 32 nozzles, i.e., from nozzle "0" to nozzle "31" are performed in a cycle of 200 μsec. A sheet is transferred over the distance of 16 μm in one cycle. Thus, a transferring speed of a sheet (i.e., a relative speed of a head) is 16/200 μm/μsec.

Figure 19B:
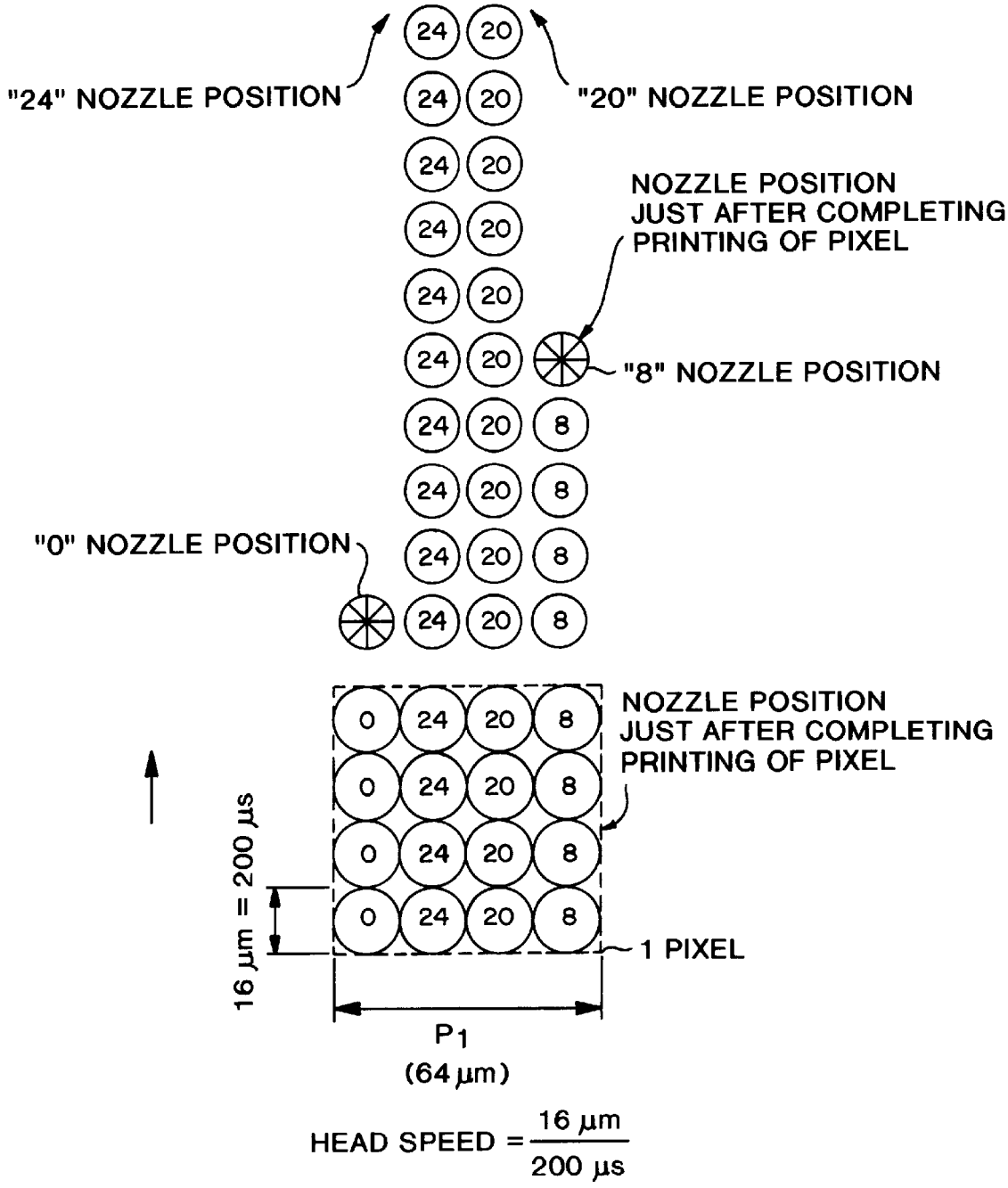

In order to arrange 16 droplets within one pixel as shown in FIG. 19B, such factors as a nozzle interval (i.e., a nozzle layout), timing for ejection from a nozzle, correction of lines for nozzles, etc. are combined. Regarding the nozzle interval in the Y-direction, ejections from nozzles "0" to "31" are performed 32 times at the rate of 16 μm (200 μsec). Hence, $P_{CN}$, which is a compensation distance for nozzle "N" (N: 0 to 31), is found by $P_{CN}=N\times16/32$ (μm). For example, in the case of nozzle "24", $P_{C24}=12$ μm.

Each nozzle in the Y direction can be arranged in accordance with $P_{CN}$ so that any deviation caused by the transfer of a sheet can be compensated for. However, such deviation is slight, and in some cases, may be negligible depending upon to what degree resolution is required or to what degree picture quality is required.

With the structure described above, the shortest distance $P_d$ between nozzles is found by:

$$P_d=\sqrt{(P_X^2+P_Y^2)}=1.25P_I=80\ \mu\text{m}$$

Thus, mechanical strength of the head can be maintained. There is the possibility that a crack may occur in a wafer forming a nozzle when $P_d$ is extremely narrower than 80 μm. Further, the shortest nozzle distance is restricted by a design, a manufacturing method, etch, but not limited to 80 μm. However, it generally suffices if it is equal to or longer than the pixel pitch $P_I$, or preferably, 1.25 times $P_I$ or longer.

As has been explained above, nozzles are arranged two-dimensionally to satisfy $0<P_X$, and $0<P_Y$. A distance between nozzles in the X direction was made smaller than a pixel pitch, and $P_X<P_I$ is satisfied. Thus, with such a structure as described above, the present invention can provide a multi-value (multi-tone) recording head which is not only compact but also maintains mechanical strength. Since the shortest distance between nozzles is expressed as $P_d>P_I$ and preferably, as $P_d\geqq1.25\ P_I$, that is, equal to or greater than a pixel pitch $P_I$, or preferably, 1.25 times $P_I$ or longer, sufficient mechanical strength can be maintained.

Further, since a distance between nozzles in the Y direction is substantially equal to a pixel pitch as expressed by $P_Y=P_I$, deviation in a nozzle layout can be readily compensated for by a line delay. More specifically, the distance between adjacent nozzles in the Y direction is expressed as $P_Y=P_I+P_{CN}$, and consequently, the deviation due to the transfer of a sheet can be compensated for, and thus, cancelled.

When m (m=4 in this embodiment but other values may be used) represents the number of nozzles in the X direction per one pixel, and k (k=4 in this embodiment but other values may be used) represents the number of ejections per one nozzle per one pixel, then, the following equation holds:

$$P_X=(m-1)/m\cdot P_I=\tfrac{3}{4}\cdot P_I$$

Consequently, compactness of the head of the present invention is achieved, while the distance between nozzles in the X direction is made as long as its maximum value.

In the foregoing description, the relations $P_X<P_I$, and $P_Y=P_I$ are satisfied. The following equations may also be possible:

$$P_Y<P_I,\ P_X=P_I \text{ or } P_X<P_I,\ P_Y<P_I$$

Figure 19C:
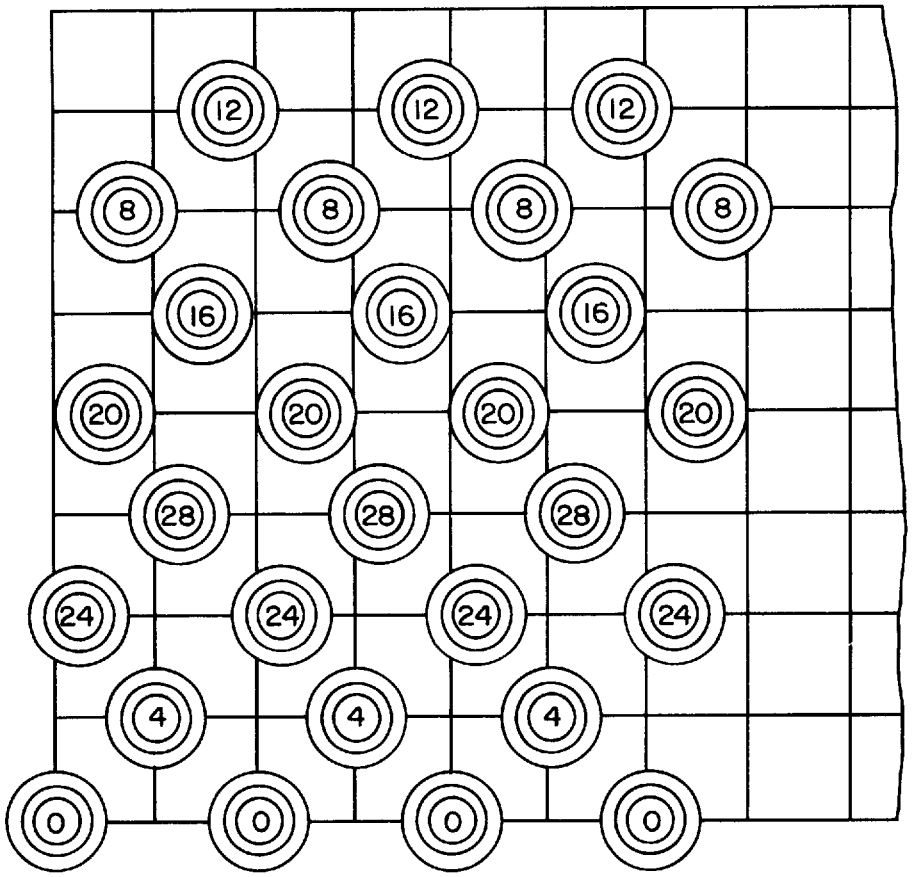

The nozzle layout described above is not limited to that of FIG. 19A, but may also be as shown in FIG. 19C.

It should be noted that although the detailed description of this specification concentrates on the four nozzle per pixel configuration, as this is the most difficult, a one nozzle per pixel configuration can be readily derived.

ZBJ Head Assembly:

The head assembly 200 must deal with several specific requirements: ink supply; ink filtration; power supply; power dissipation; signal connection; and mechanical support.

The ZBJ head 200 with 51,200 nozzles, each of which can eject a 3 pl ink drop every 200 microseconds, can use a maximum of 1.28 ml of ink per second. This occurs when the head 200 is printing a solid four-colour black. As there are four colours, the maximum flow is 0.23 ml per colour per second. If the ink speed is to be limited to around 20 mm per second, then the ink channels 211–214 must have a cross-sectional area of 16 $mm^2$ each.

Any particles carried in the ink that are less than 60 microns in diameter will be carried into the nozzle channel 114. Any of these particles which are greater than 20 microns in diameter cannot be ejected from the nozzle 110. Even if pre-filtered ink is supplied to the user, there is a possibility of particle contamination when the ink is re-filled. Therefore, the ink must be effectively filtered to eliminate any particles between 20 and 60 microns.

With regard to power supply, the peak current consumption of the full width colour ZBJ head 200 is about several amperes. This must be supplied to the entire length of the chip 100 with an insignificant voltage drop. Also, the ZBJ head has more than 35 signal connections, the exact number depending upon the chosen circuit design, and an accordingly insignificant voltage drop is also required.

Mechanical support to the ZBJ chip 100 can be provided by the ink channel extrusion 210 in the manner shown in FIG. 13. The ink channel 210 extrusion has three functions: to provide the ink paths and keep the four colours separate; to provide mechanical support for the ZBJ chip 110; and to assist in dissipating the waste heat to the ink 106.

It is for these reasons it is preferable that the ink channels extrusion 210 be extruded from aluminum, and anodised to provide electrical insulation from the busbars 201 and 202. The manufacturing accuracy of the extrusion 210 need only be maintained to approximately ≦50 microns, as the extrusion 210 is not in contact with the nozzles 110. The edges of the channel extrusion 210 should be sealed against the ZBJ chip 100 to prevent air from entering the head assembly 200. This can be achieved with the same epoxy as that used to glue the assembly 200.

FIG. 20 illustrates an exploded perspective view of a preferred construction of a high speed full colour ZBJ assembly 200. The filter 205 is preferably a 10 micron (or finer) absolute filter such as a filterite "Duofine" (Trade Mark) bonded fiberglass filter. The surface area of this filter through which the ink must flow is 528 $mm^2$. With an ink flow rate of 1.28 ml per second, the ink must pass through the filter at a velocity of 2.4 mm per second. If the filter 205 is compressible, it can also form a gasket to prevent pigment flow between the four colours. In this case, the ZBJ chip 100 can be glued to the extrusion 210 under pressure. Alternatively, a silicone rubber seal can be used. In this case, care must be taken not to contaminate the ink channels 211–214.

One way of supplying the necessary power to the chip 110 is by power connections which run the full length of the chip 110. These can be connected using tape automated bonding (TAB) to the busbars 201 and 202 which form part of the head assembly 200. The signal connections to the ZBJ chip 100 can be formed using the same TAB tapes as are used to supply power to the ZBJ chip 100. Furthermore, as in FIGS. 4A and 4B, the busbars 201, 202 can be configured as heat sink elements surrounding the extrusion 210.

Figure 21:
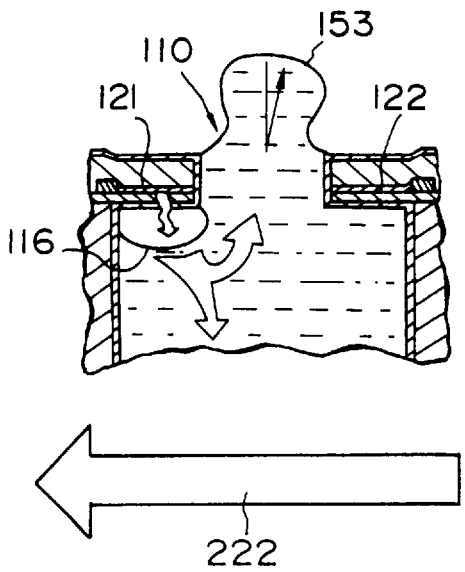
FIGS. 21 and 22 illustrate the deflection angle imparted on the ink drop due to the main and redundant heaters respectively.
Figure 22:
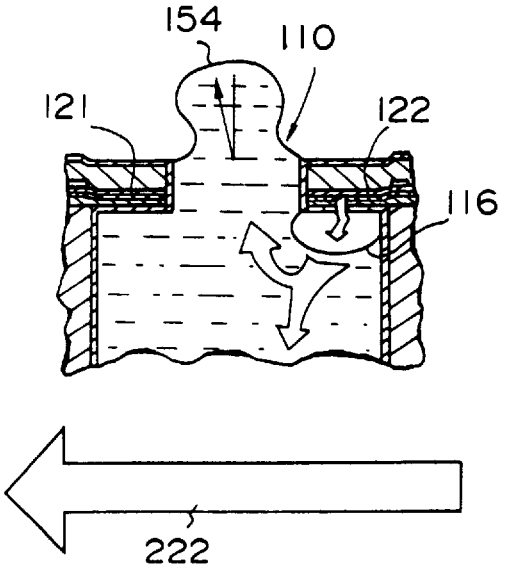

Ink Drops:

With the fault tolerant design requiring the formation of two separate heater elements, 121, 122, the ink drop 108 does not necessarily exit perpendicular to the ZBJ head surface. The ink drop 108 can be deflected by the shock waves of the expanding bubble at different angles depending on whether the main 121 are redundant 122 heater was fired. Such a configuration is illustrated in FIGS. 21 and 22 respectively.

The angle and degree of the deflection 153 and 154 will depend upon the exact geometry of the ZBJ nozzle 110, and the mode of propagation of the bubble's 116 shock wave through the ink 106. The exit angle of the drop 108 is not important in itself. However, any difference between the exit angle of the drop fired by the main heater 121 and one fired by the redundant heater 122 will degrade the image quality slightly. The above can be reduced in two ways:

Firstly by positioning the head 200 closer to the paper 220 to reduce the distance between the two spots on the paper 220, and secondly by delaying the time of the redundant nozzle firing so that the paper movement cancels the deflection angle 153 or 154. This requires that the main and redundant heaters be aligned in the direction of paper movement 222.

Power Supply:

The A4 full width continuous tone ZBJ head 200 has a high current consumption of several amperes when operating. The distribution of this current to and across the chip 100 is not possible using standard integrated circuit construction. However, the geometry of the ZBJ chip 100 leads to a simple solution. The entire edge of the chip 100 can be used to supply power, with connections begin made to a wide aluminum trace along both of the long edges of the chip 100. Power can be supplied by the busbars 201 and 202 along both sides of the chip 100 connected to the chip by tape automated bonding (TAB) compressible solder bumps, spring leaf connection to gold plated traces, a large number of wire bonds, or other connection technology.

FIGS. 23A and 23B illustrate one method of TAB connection along the length of the ZBJ chip 100 with the connections shown in magnified detail FIG. 24 shows a magnification of an alternate arrangement using a knurled edge for multipoint contacts.

With reference to FIGS. 23A and 23B, the heatsink/busbar (51,52) (201,202) can readily be made larger, or of different shape, or of different materials without affecting the concept of the ZBJ head 200. Forced air, heat pipes or liquid cooling can also be used. It is also possible to reduce the current consumption by reducing the duty cycle of the nozzle 110. This will increase the print time, but reduce the average power consumption. The total energy required to print a page will not be affected.

Power Dissipation:

The full length full colour head can have a power dissipation of up to 500 watts when all nozzles are printing, depending on the nozzle efficiency. Before a final design of ZBJ head can be derived, the following should be taken into account, as all these factors affect heat generation and dissipation.

(1) The number of nozzles: The number of nozzles 110 directly effects the power dissipation, but is also linked to print speed, image quality and continuous tone issues.

(2) Heater energy: The heater energy is typically 200 nJ per drop. Any reduction in heater energy allows the power dissipation to be reduced without affecting print speed.

(3) Supply Voltage: A low supply voltage is desirable. However, a reduction in voltage increases the current consumption and the size of on-chip driver transistors. Power dissipation will not be greatly affected by the supply voltage if the nozzle energy is maintained constant. In the preferred embodiment a supply voltage of +24 V is used for the heater drivers and +5 V for logic electronics.

(4) Nozzle duty Cycle: Increases in the nozzle duty cycle directly increases the power consumption but also increases the print speed.

(5) Print Speed: Print speed is related to the number of nozzles 110, the number of drops per pixel, the pixel size and the nozzle duty cycle. A reduction in print speed can reduce power requirement, but typically will not affect the total energy per page.

(6) Permissible Chip Temperature: The chip temperature must be maintained well below the boiling point of the ink 106 (generally about 100° C.)

(7) Ink Channel Geometry: This will affect the amount of heat dissipation available through the ink 106.

(8) Cooling Method: Convection cooling is adequate for scanning heads, but full length heads require additional methods such as heat sinks, forced air cooling or heat pipes. Liquid cooling is a possible solution to the problem of higher power density in the head strip. As liquid ink is already in contact with the head, a recirculating pumped ink system with a heat exchanger can be used if heat dissipation problems cannot be solved by easier methods.

(9) Ink Thermal Conductivity: The thermal conductivity of the ink 106 becomes relevant if the ink is to provide a significant power dissipation conduit.

(10) Ink Channel Thermal Conductivity: The thermal conductivity of the ink channel extrusion 210 is also relevant.

(11) Heat Sink Design: Heat sink size and design can be readily changed to provide optimum heat dissipation. The heat sink can be made quite large with little expense and little adverse effect at the system level. This is especially true of the full page versions as the ZBJ head 200 does not move (i.e. the paper moves relative to the head 200).

(12) High temperatures: The operating temperature of the ZBJ heater elements 121,122 is in excess of 300° C. It is important that the active elements (drive transistors and logic) of the ZBJ chip 100 do not experience this temperature extreme. This can be achieved by locating the drive transistors as far from the heater elements 121, 122 as possible. The active elements can be located at the edges of the chip 100, leaving only the heaters 120 and the aluminum connecting lines in the high temperature region. Also, obtaining adequate heat transfer is a serious potential problem. The heater 120 temperature must be kept well below the boiling point (100° C.) of the link 106. While heat transfer from the heat sink (51, 52) to ambient area should not be a problem, transferring heat from the chip 100 to the heat sink (51, 52) efficiently is important.

Heater Drive Circuits

Figure 25:
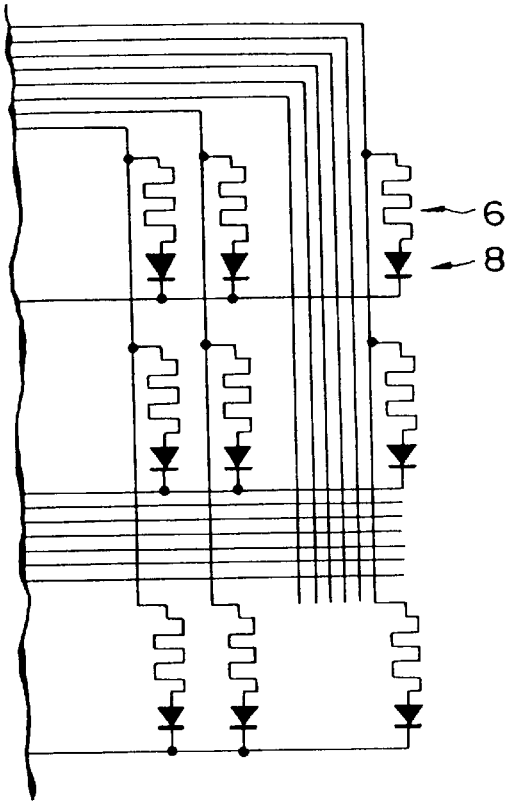
FIG. 25 (PRIOR ART)
FIG. 25 shows an arrangement of heaters in a prior art BJ head.

The scanning bubblejet head used in Canon's BJ10 printer has 64 nozzles energised by an array of heaters 6 which are shown in FIG. 25. These are multiplexed into an 8×8 array using diodes 8 integrated onto the chip. External drive transistors (not illustrated) are used to control the heaters 6 in eight groups of eight heaters 6.

The prior art approach has several disadvantages for large nozzle arrays. Firstly, all of the heater power must be supplied via the control signals and this can require a large number of relatively high current connections. Also, the number of external connections becomes very large.

The preferred embodiment of the ZBJ chip 100 includes drive transistors and shift registers on the chip 100 itself. This has the following advantages:

(1) Fault tolerance can be implemented at low cost, with no external circuitry;

(2) All heater power is supplied by two large connections, V+ and ground with control lines being at signal levels only;

(3) The number of external connections is small, irrespective of the number of nozzles 110;

(4) External circuitry is simplified;

(5) No external drive transistors are required; and (6) There is only one transistor in series with each of the heaters 121,122, instead of two transistors and a diode 8 as with the prior art. This allows a possible reduction in operating voltage.

However, disadvantages of this approach are:

The ZBJ chip 100 circuit is more complex; and

More semiconductors manufacturing process steps are required thus reducing the yield.

Figure 26:
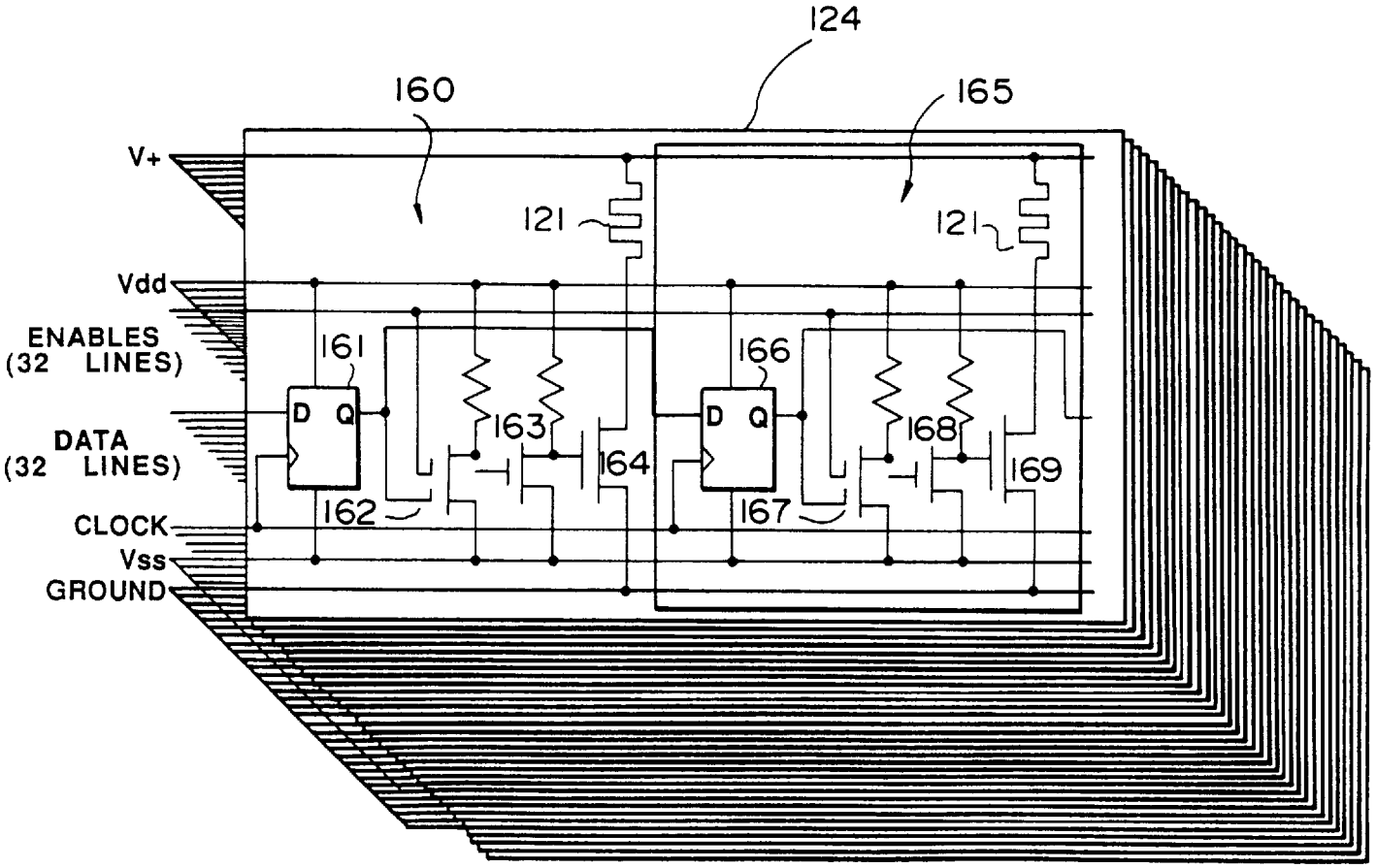
FIG. 26 shows the arrangement of heater drivers within the preferred embodiments.

FIG. 26 shows the logic and drive electronics of the ZBJ chip 100 with 32 parallel drive lines, corresponding to the 32:1 nozzle duty cycle. The enable signals provide the timing sequence, firing each of the 32 banks of nozzles 110 in turn. The enable signals can be generated on-chip from a clock and reset signal.

In FIG. 26, the Vdd is +5 volts and Vss is tied to a clean ground point. V+ and ground have a noise level of up to several amperes, so they may not be suitable for logic event though they are supplied to the chip 100 at a very low impedance.

Shown in FIG. 26 is a heater driver 124 for two nozzles 110. The drivers 124 consist of two individual drivers 160 and 165 for two nozzles (without fault tolerance) showing the data connections of the shift registers.

Each heater driver 160, 165 consists of four items:

(1) A shift register 161, 166, to shift the data to the correct heater drive. The shift register 161, 166 can be dynamic to reduce the transistor count;

(2) A low power dual gate enable transistor 162, 167;

(3) A medium power inverting transistor 163,168. This inverts and buffers the signal from the enable transistor 162, 167 and combines with the enable transistor 162, 167 to provide an AND gate; and (4) A 1.5 milliamp drive transistor 164,169. The AND function is not incorporated into the drive transistor 164, 169 as the capacitance on the enable lines to too large.

For a ZBJ head with 1,024 (32×32) nozzles, the clock period is the same as the pulse width, because 32 bits of data must be shifted in each shift register between nozzle firings, and there is a 32:1 duty cycle. The circuit of FIG. 26 is only suitable for a ZBJ head with less than 1,024 nozzles. However, where there is only a small number of nozzles an active circuit provides little advantage, and a diode matrix can be used.

For larger heads, with more than 1,024 nozzles, the clock required to shift all of the data to the appropriate nozzles requires a period shorter than the heater pulse. For the full width high sped full colour ZBJ head 200 of FIGS. 5A and 5B, 51,200 bits of information must be shifted into the head in 200 microseconds. This requires a clock rate of about 8 MHz. The data at the shift registers 161, 166 therefore only need be valid for 125 nS but is required for the full duration of the 6.25 microsecond heater pulse. Disclosed herein are two solutions to this problem, one being the use of a transfer register and the other being the use of clock pauses.

Figure 27:
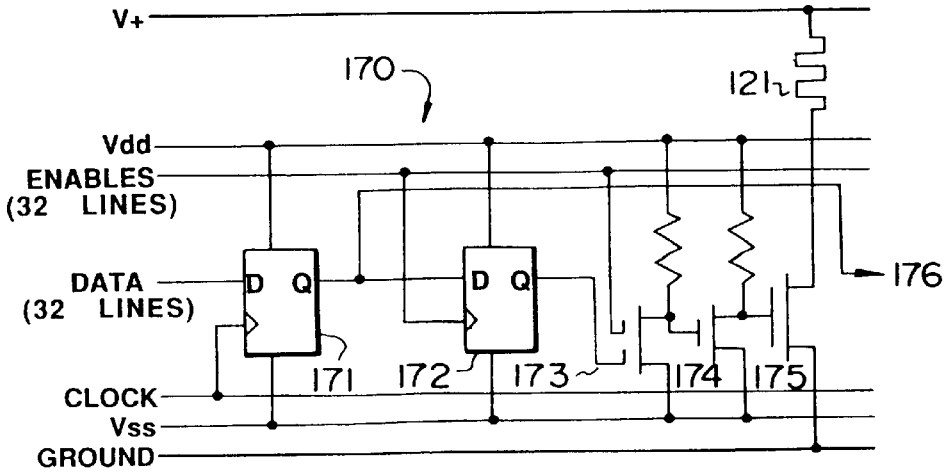
FIG. 27 shows a heater driver including a transfer element.

FIG. 27 illustrates the addition of a transfer register 172 to a main heater drive 170 having componentry otherwise corresponding to that of FIG. 26. This arrangement provides a simple solution to the above problem but has the disadvantage of increasing the amount of circuitry on the chip 100. 1,600 bits of data are shifted into each shift register 171 at 8 MHz. When the enable pulse occurs, the data is parallel loaded to the transfer register 172 where it is stable for the duration of the heater pulse.

Figure 28A:
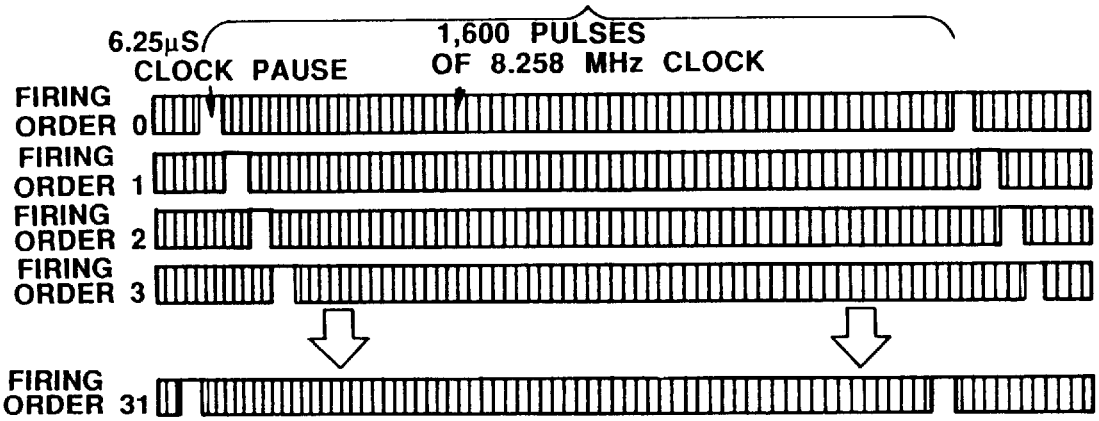
FIG. 28 is a timing diagram of pulses used for driving the heaters.
Figure 28B:
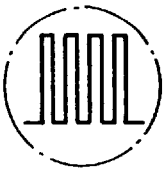

An alternative which avoids the extra transistors of the transfer register 172 is to introduce pauses into the clock stream for the duration of the heater pulse, so that the data does not change during the pulse. This is illustrated in FIGS. 28A and 28B and in this case, the 1,600 bits of data are shifted into the register at a slightly higher rate—8.258 MHz—after which there is a pause in the clock for 6.25 microseconds, the period of a heater pulse. Each of the 32 rows of heaters fire at different times. The clocks for each row can be simply generated by gating the constant 8.258 MHz clock with the heater enable pulses.

Figure 29:
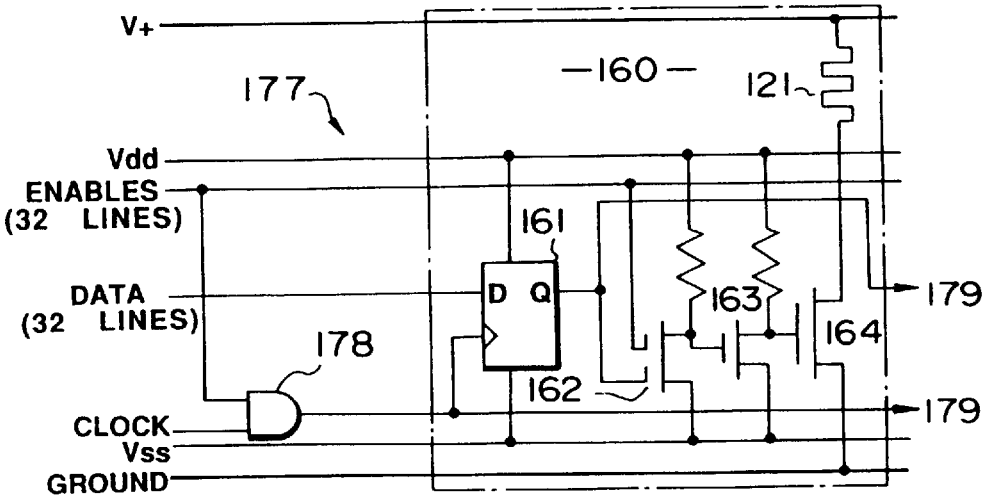
FIG. 29 shows the circuit arrangement of a heater driver using a single clock pulse.

FIG. 29 illustrates one stage of a ZBJ drive circuit 177 which incorporates clock pauses. An AND gate 178 connects between the clock and Enable lines and drives the CLK inputs of the shift registers 161 (and 166 not illustrated but connected at 179).

This approach has the disadvantage of requiring relative complex data timing on the chip 100. However, this can be supplied at low cost by the custom designing of ZBJ data phasing chips 310 such as those shown in FIG. 32 (to be later described).

Long Clock Lines:

For the full length colour ZBJ head 200 having 51,200 nozzles, with full redundancy, there are 102,400 shift register stages distributed over a length of 220 mm. These are structured as 64 shift registers each with 1,600 stages. Transmission line effects and the large fanout necessary preclude the clock from being driven by a single line. Fortunately, the clock can be regenerated at short intervals. If the clock is regenerated 32 times, each clock segment will have a fanout of 50, and will be only 6.8 mm long.

Figure 30:
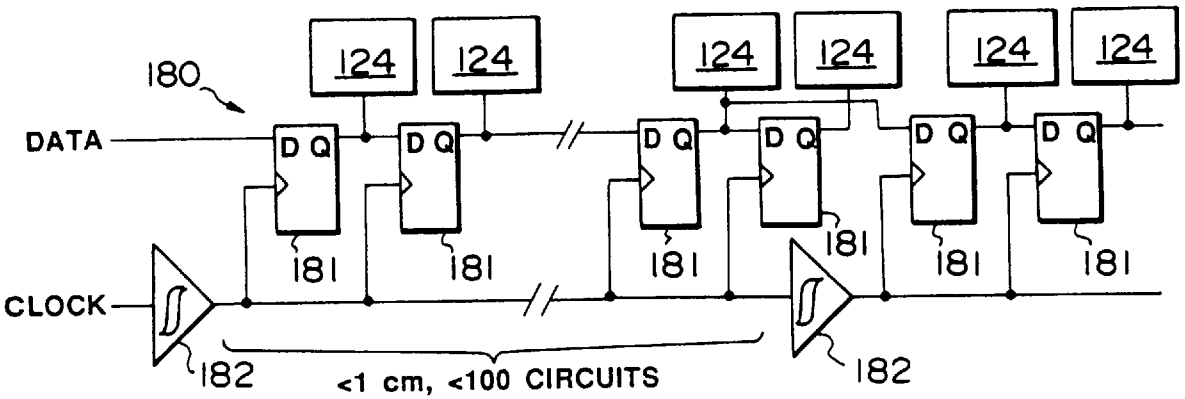
FIG. 30 shows the circuit arrangement of a clock regeneration scheme.

In FIG. 30, a simple clock regeneration scheme 180 is shown including a chain of shift registers 181 each supplying a corresponding heater driver 124. Included in the clock line are Schmitt triggers 182 equally spaced depending on the permissible fanout. As seen, where a Schmitt trigger 182 occurs in the chain, the next corresponding shift register 181 is input not from the shift register 181 immediately preceding it in the chain, but from the one before that. This compensates for the delay imposed by the Schmitt trigger 182.

Clock regeneration is degraded by the introduction of a propagation delay ($T_{PD}$) at every regeneration stage. If the propagation delay of each regenerator is substantially less than the clock period, the ZBJ circuit will still function. This is because the data of each stage of shift register 181 will also be delayed by $T_{PD}$ every time a regenerated clock is encountered. Therefore, the valid data window will not change. With an 8 MHz clock, $T_{PD}$ must be less than 125 nS and greater than the propagation delay of the shift register. This can be readily achieved.

Figure 31:
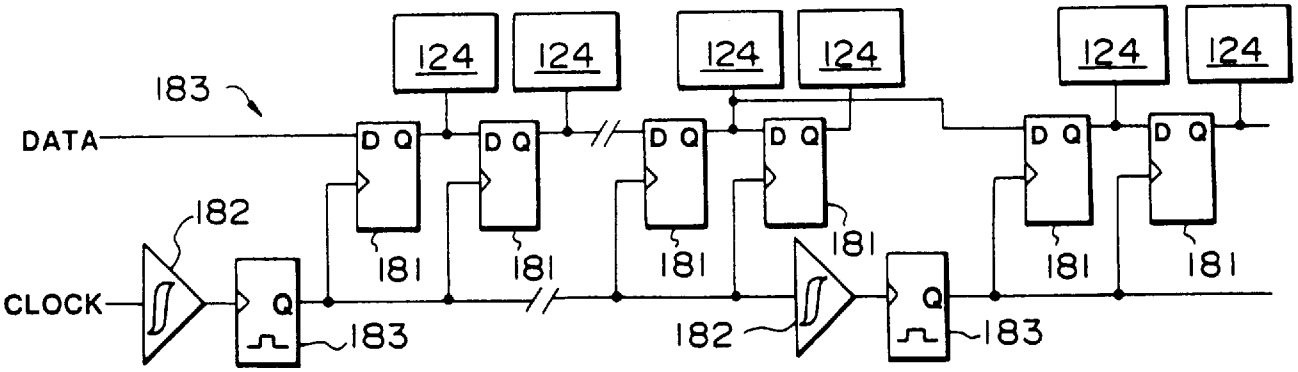
FIG. 31 shows a circuit arrangement for regenerating pulse widths within the clock line.

Any digital circuit will have a difference between rise and fall times ($T_{PLH}$–$T_{PHL}$) In a 2 micron NMOS ZBJ circuit, these times will be quite large, due to the high capacity load and passive pull-up on the clock regenerator outputs. A $T_{PLH}$–$T_{PHL}$ value of 5 nS is a reasonable assumption. Under these conditions, the clock pulse will disappear after only thirteen stages of regeneration. A solution is to regenerate the pulse width with a monostable at every stage, as shown in FIG. 31, which essentially corresponds to FIG. 30 save for the insertion of a monostable 183 after each Schmitt trigger 182 in the clock line.

The actual pulse width generated by the monostable 183 is not critical, it must be longer than the minimum pulse width required by the shift registers 181 (about 10 nS), and shorter than the clock period (125 nS). This tolerance is important to allow for the inaccuracy of component values in monolithic circuits.

External Driver Circuit

Figure 32:
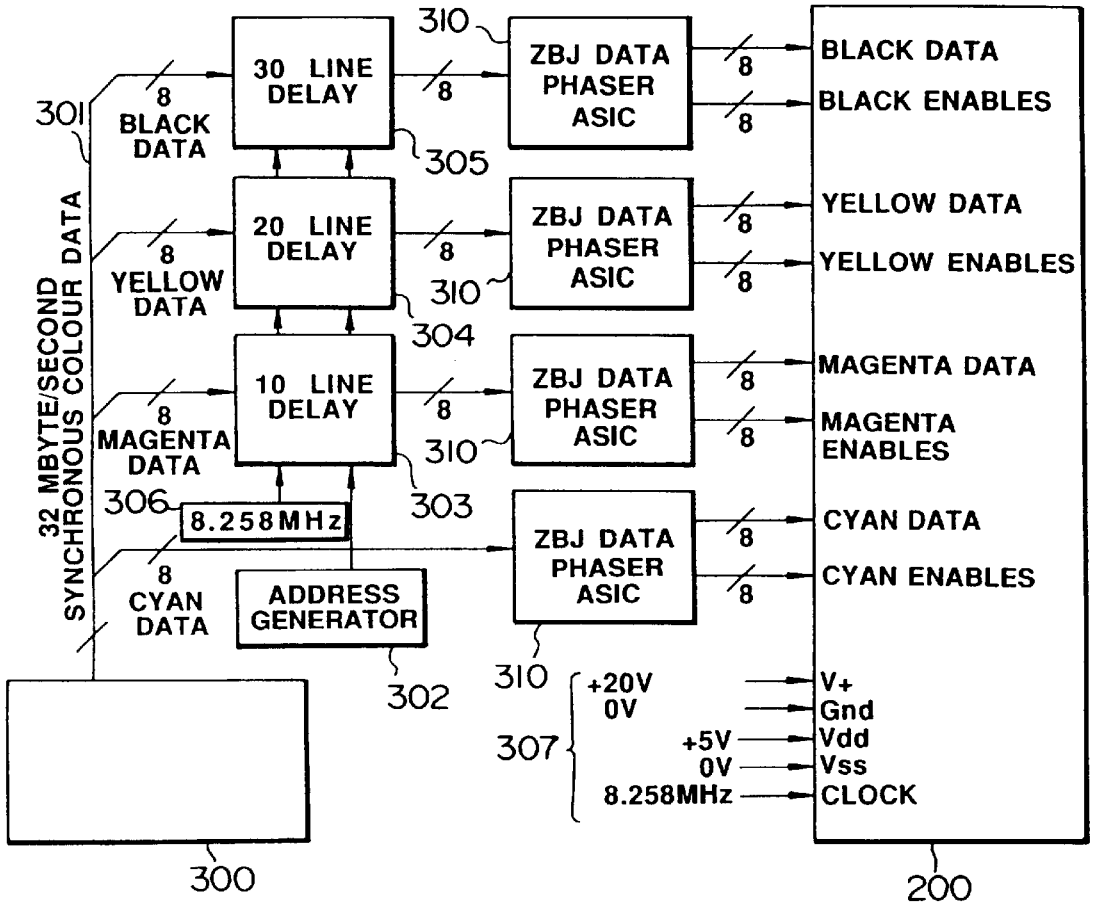
FIG. 32 is a schematic block diagram of the data driving circuit configuration used for the ZBJ head.

The full colour ZBJ head 200 requires a data rate of 32 MBytes per second (8 Mhz average clock rate×32 bits). This data must be delayed by up to 7,600 microseconds, and requires nearly 1 megabit of delay storage. If the clock pause system described earlier (FIG. 29) is used to reduce the logic on the ZBJ chip 100, then data must also be presented to the ZBJ chip 100 with a complex timing scheme FIG. 32 is a block diagram of an overall data driving scheme for the full colour ZBJ head 200 in which an image data generator 300, such as a computer, copier or other image processing system, outputs colour pixel image data on a 32 bit bus 301. The colour pixel image data on a 32 bit bus 301. The colour pixel image data is normally supplied in raster format (cyan, magenta, yellow and black (CMYK)) with components for each colour being provided simultaneously on the bus 301. Because it is not possible for the nozzles for each colour to sit one on top of the other for simultaneous printing, the different colour data must be appropriately delayed prior to being supplied to the head 200. The colour data produced by the computer 300 on the bus 301 is digital data at 1600 dpi with pre-calculated screen or dithering simulating 400 dpi continuous tone colour image.

The bus 301 is divided into blocks of its component colours (cyan, magenta, yellow and black) each of which is respectively input to the ZBJ head 200. The magenta, yellow and black data are delayed by respective line 303, 304 and 305 because these colours are printed sequentially after cyan for each pixel across the head 200. An address generator 302 is used to sequence colour data through the line delays 303–305. A clock 308 of 8,258 MHz is used to sequence all pixel data and is also supplied to the head 200, which also has a number of power connections 307 as illustrated.

The 10, 20 and 30 line delays are formed using three standard 65K×8 SRAMS with a read/modify/write cycle time of less than 120 nS. This achieved by reading and then writing the SRAMS with the data, while incrementing the address modulo 16,000, 32,000 and 48,000 respectively. The address generator 302 is a simple modulo 16,000 counter, with the two most significant bits of the address of each SRAM generated separately.

Because of the staggered configuration of the nozzles 110 for each array, as seen in FIGS. 19A–C, the delays to each data line are different. Generally the provision of these delays requires a large number of standard chips. For this reason, a ZBJ data phaser ASIC 310 is provided to buffer each nozzle array input so as to reduce system complexity. A single ASIC can be constructed which can be used to provide delays for the 8 bits of any of the four colours.

ZBJ Head Cost:

For full colour full length ZBJ heads to be applicable to large markets, such as colour photocopies and printers selling for less than about US$5,000, the manufacturing cost of the head should as low as possible. In general, a target assumed for each head is about US$100 or less in volume with a mature process. The ZBJ head 200 is essentially a single piece construction and the head cost will consist almost entirely of the ZBJ chip 100 itself. The ZBJ chip 100 cost is determined by processing cost per wafer, number of heads per wafer, and yield. Assuming that the processing costs per wafer is about $800, and the number of heads per wafer is 25, the pre-yield cost per head is $32.

To achieve a head cost of $100, the mature-process yield must be about 30%. However, the chip area for the full colour full length ZBJ heads 200 is of the order of 8.8 $cm^2$. Those skilled in the art would initially believe that such a large size would imply a yield close to zero. However, there are several factors which make the expectant yield not as low as first impressions. These factors are:

(1) Most of the chip 100 consists of heaters, nozzle tips, and connecting lines, which should not be sensitive to point dislocations in the silicon wafer;

(2) The majority of the chip 100 has a three micron or greater feature size, and will be relatively insensitive to very small particles;

(3) The chips 100 are not subject to semiconductor processing steps in areas likely to be affected by wafer-etch rounding, resist-edge beading, or process shadowing (i.e. there are no active circuit elements near the nozzles).

The fault tolerance redundancy of the ZBJ head is preferably provided to improve the yield. This can allow a large number of defects to exist on the chip without affecting the operation of any of the nozzles. Furthermore, it is not necessary to incorporate 100% redundancy, but it is necessary to reduce the non-redundant region of the ZBJ head to a size consistent with an adequate yield. The effect of fault tolerance on yield is discussed later in this specification. Even with fault tolerance, there are several factors which can act to reduce yields below reasonable levels. Some of these factors are:

(1) Process variations whereby large area variations in process parameters such as etch depth and sheet resistance beyond acceptable limits will result in no yield from affected wafers. Generally, tolerances on these parameters are matched to the ZBJ head requirements during production engineering;

(2) Mechanical damages: if the mechanical strength of any ZBJ head design is adequate to withstand processing stresses, the ZBJ design can be altered to provide adequate strength. However, this alteration is normally at the expense of the chip area, and therefore yield;

(3) Wafer taper: the ZBJ chip 100 is unusually sensitive to wafer taper due to the back-etching of the nozzles 110. Wafers should be polished to reduce taper to less than 8 microns before processing;

(4) Slip: as the chips 100 extend the entire length of the wafer, major slip defects can reduce yield to zero. A special furnace design and processing can be provided to accommodate the long rectangular wafers;

(5) Etch depth: this must be consistent to within 5% over the entire wafer to ensure that the barrel plasma etch does not etch the heater. If this tolerance is unable to be achieved, the particular ZBJ design should be altered to be less sensitive to etch variations.

Fault Tolerance

As indicated earlier, fault tolerance is included in the ZBJ chip 100 so as to improve yield as well as to improve head life. The provision of fault tolerance is considered essential so as to achieve low manufacturing costs of the ZBJ chips 100. Furthermore, while the fault tolerance concept described herein is specifically applied to the ZBJ chip 100, the same concept can be used for other types of BJ heads if a configuration with two heaters per nozzle is created.

The disadvantage of fault tolerance is that chip complexity is doubled. However, due to the topography of the nozzles 110, there is only a slight (about 10%) increase in chip area. The yield decrease this causes is dwarfed by the yield increase provided by fault tolerance.

The ZBJ system described herein implements fault tolerance by providing two heater elements 121, 122 for each nozzle 110. As the nozzles 110 are circular and on the surface of the chip 100, each heater 120 is provided with two heater elements 121, 122 on opposite sides of the nozzle 110 and preferably having identical geometries. The heater elements are termed a main heater 121 and a redundant heater 122. Accordingly, the ink drop fired from the nozzle tip 111 by either heater 121 or 122 is essentially the same.

Control of the redundant heater 122 for fault tolerance is provided by sensing the voltage at the drive transistor to the main heater 121 drive. This node makes a high-to-low transition every time the nozzle 110 is fired. Three faults are detected by the behaviour of this node:

1. Open heater: if the heater 121 is open circuit, the node will be stuck low;
2. Open drive transistor: if this occurs, the node will be stuck high; and
3. Shorted drive transistor: if the transistor is short, the heater will overheat, go open circuit and the node will be stuck low.

Lithography

The full width colour ZBJ chip 110 has dimensions of approximately 220 mm×4 mm, yet requires very fine line widths, such as 3 microns for the one nozzle per pixel design, and 2 microns for the four nozzle per pixel design. The maintain focus and resolution when imaging the resist patterns is difficult, but is within the limits of current technology.

Either full wafer projection printing or an optical stepper can be used. In both cases, the projection equipment requires modification to the stage to allow for 220 mm travel in the long axis.

In a 1:1 projection printing system, a scanning projection printer is modified to match the mask transport mechanism to permit very long masks. Defects caused by particles on the mask are projected at a 1:1 ratio and are in focus, so cleaner conditions are required to achieve the same defect level. A 1:1 projection printer also requires a mask of an image area of 220 mm×104 mm. This requires modification to the mask fabrication process. The manufacturing of 2 micron resolution masks of this size is viable for high volume production, but the masks are very expensive in small volumes. For these reasons, a stepper configuration should also be considered.

The use of 5:1 reduction stepper reduces some of the problems associated with a scanning projection printer, particularly those associated with the production of very large masks, and the particle contamination of the mask. However, some new problems are introduced. Firstly, a different imaging area of 10 mm×8 mm is used. Then the full size wafer can be imaged in 22×13 steps. This provides a total of 286 steps which generally takes about 250 seconds to print. As there are approximately 10 imaging steps required for the manufacture of the ZBJ chip 100, total exposure time per wafer can be about 2,500 seconds which substantially reduces the production rate of such devices. Also, the use of the wafer stepper introduces the following two problems which effect the ZBJ chip design:

1. The ZBJ chip 100 is longer than the step size in one axis; and
2. The makes cannot readily be changed during exposure of the wafer, therefor one mask must be used for the entire head.

The first of these problems can be countered by using a repeating design, and ensuring that alignment at the perimeters of that repeating block is not critical. As the wafer 149 is only diced in one direction, the repeating block does not have to be rectangular, but can avoid critical features such as nozzles. The left hand and right hand edges of the mask pattern can be quite irregular, provided they match each other.

Also, each signal line must terminate at the bonding pads 207, 223, which are typically arranged at the side edges of the chip 100. This normally requires that the side edges of the chip 100 be imaged with a different pattern than that of the centre of the ZBJ chip 100. This can be achieved by blading the mask to obscure the bonding pads and associated circuitry on all but the first exposure of the chip.

ZBJ Production Process:

The ZBJ chips 100 can be processed in a manner very similar to standard semiconductor processing. There are however, some extra processing steps required. These are: accurate wafer thickness control, deposition of a $HfB_2$ heater element; etching of the nozzle tip; back etching of the ink channels; and back etching of the nozzle barrels.

A 2 micron NMOS process with two level metal is assumed as this is the basis of the four nozzle per pixel design. CMOS or bipolar processes can also be used.

Wafer preparation for scanning BJ heads is similar to that for standard semiconductor devices, except that the back surface must also be accurately ground and polished, and wafer thickness maintained at better than 5 microns. This is because both sides of the wafer are photolithographically processed, and etch depth from the reverse side is critical.

Full width fixed ZBJ chips require different wafer preparation than do those used in scanning heads, as the ZBJ chip must be at least 210 mm long in order to be able to print an A4 page, and at least 297 mm long for a A3 pages. This is much wider than the typical silicon crystalline cylinder. Wafers can be sliced longitudinally from the cylinder to accommodate the long chips required.

When the wafer has been ground and polished the resultant wafer should generally be about 600 microns thick. The resultant wafer is a rectangular shape approximately 230 mm×104 mm×600 microns thick. On this wafer, approximately 25 full colour heads can be processed. Such a wafer will appear similar to that of FIG. 69. A 230 mm long 6 inch cylinder can be used to produce up to 2,600 full width, full colour heads before yield losses.

Due to the one piece construction of the ZBJ print chip 100, and the use of a stepper for exposure, wafer flatness requirements are no more severe than those of the transistor fabrication processes. The wafer can be gettered using back-side phosphorous diffusion, but back-side damage can result and therefore is not recommended because the back-side is subsequently etched.

Wafer processing of the ZBJ chip 100 uses a combination of special processes required for heater deposition and nozzle formations, and standard processes used for drive electronics fabrication. As the size of the ZBJ chip 100 is largely determined by the nozzles 110 and not by the drive transistors 164, 193, there is little size advantage in using a very fine process. The process disclosed here is based on a 2 micron self-aligned polysilicon gate NMOS process, but other processes such as CMOS or bipolar can be used. The process size disclosed here is the larger size compatible with the interconnect density required to the nozzles 113 of the high density four colour ZBJ head. This also requires two levels of metal. Two levels of metal can be required for simpler heads, as high current tracks run across the chip, and very long clock tracks run along the chip.

The wafer processing steps required for the formation of the ZBJ nozzles 110 are intermingled with the steps required for the drive transistors. As the process used for the drive transistors can be standard as known to those skilled in the art, there is no requirement to specify such steps in this specification.

Figure 33:
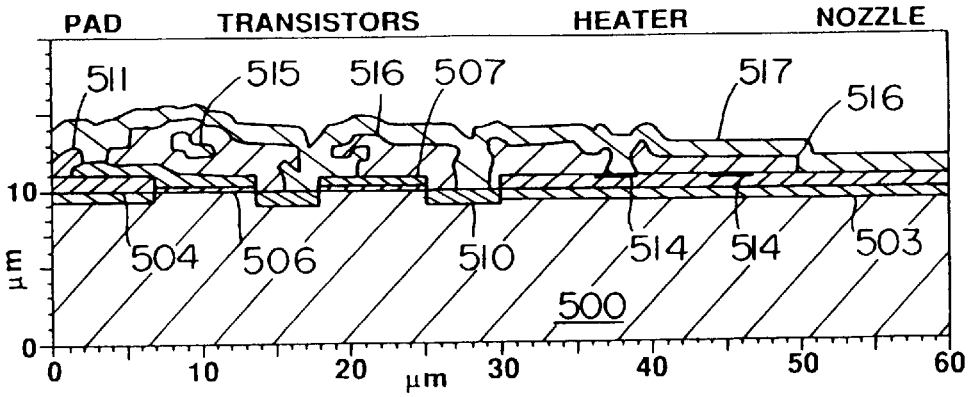
FIGS. 33, 34, 35, 36, 37, 38, 39, 40, 41, 42, and 43 show the manufacturing stages of a preferred embodiment.

FIG. 33: A 1 micron second level metal layer 517 of aluminum is evaporated over the wafer 500. This metal layer 517 provides the second level of contacts. This is required because a high wiring density is required to the heaters 514, which must be metal for low resistance. This layer also provides the thermal diffuser or thermal shunt.

Figure 34:
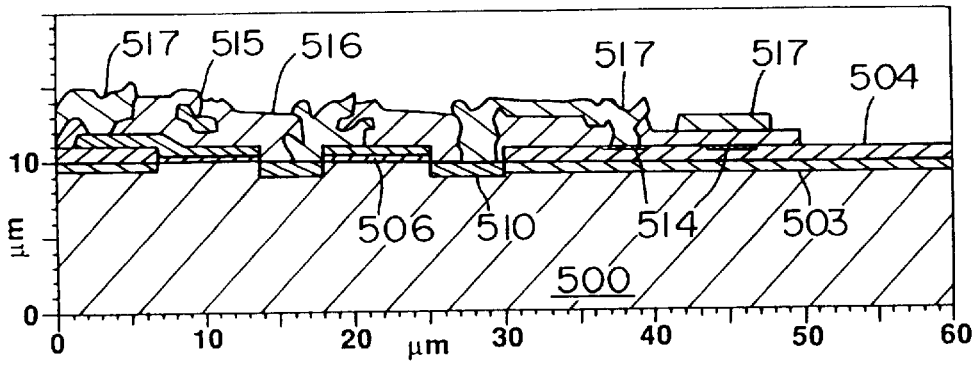

FIG. 34: The second level metal 517 is etched using an eighth mask. This step requires spin coating of resist, exposure to the eight mask, development of the resist, plasma etching, and resist stripping. This is normal NMOS step. The isolated metal disk above the heaters 514 is the thermal diffuser used to distribute water heat to avoid hot-spots.

Figure 35:
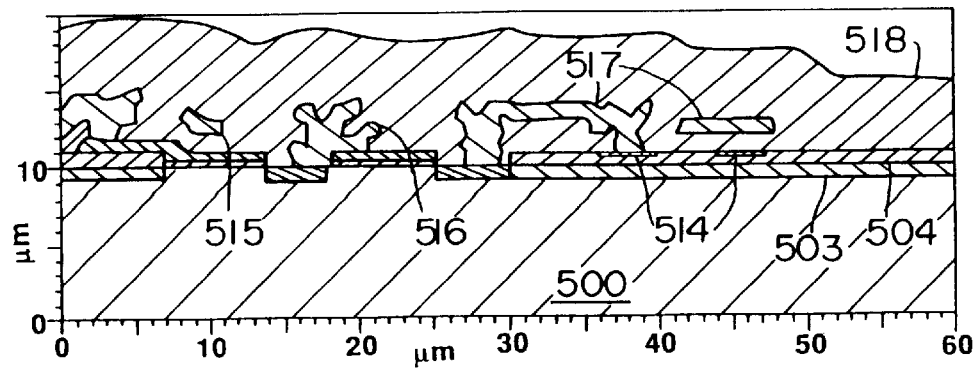

FIG. 35: A thick layer 518 of glass is deposited over the wafer 500. The layer 518 must be thick enough to provide adequate mechanical strength to resist the shock of imploding bubbles. Also, enough glass must be deposited to diffuse the heat over wide enough area so that the ink does not boil when in contact with it. A 4 micron thickness is considered adequate, but can be easily varied if desired.

Figure 36:
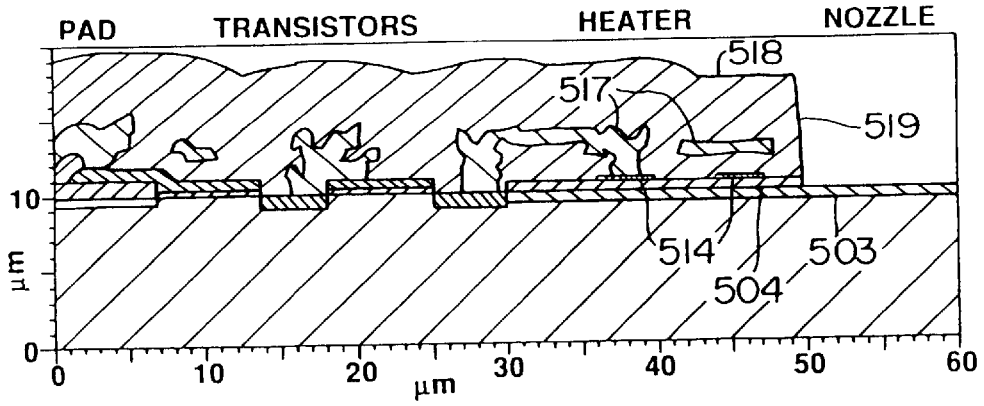

FIG. 36: This step requires etching using a ninth level mask of a cylindrical barrel 519 into the overcoat 518, through the thermal oxide layer 504 down to the implanted field 503. Both CVD glass and thermal quartz are etched. This step requires spin coating of resist, exposure to a ninth level mask, development of resist, and anisotropic ion enhanced etching, and resist stripping.

Figure 37:
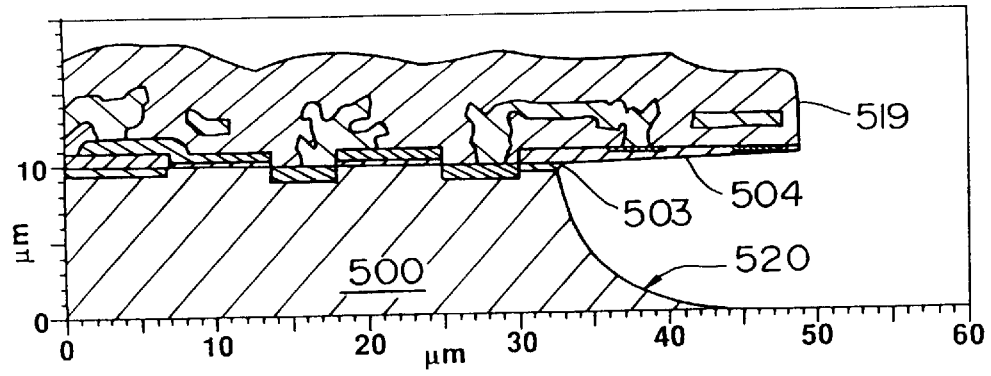

FIG. 37: The thermal chamber 520 is formed by an isotropic plasma etch of silicon, highly selective over $SiO_2$. This is essential, as otherwise the protective layer of $SiO_2$ separating the heater 514 from the passivation will be etched. The previously etched barrel 519 acts as the mask for this step. In this case, an isotropic etch of 17 microns is used. Care must be taken not to fully etch the thermal $SiO_2$ layer 504.

Figure 38:
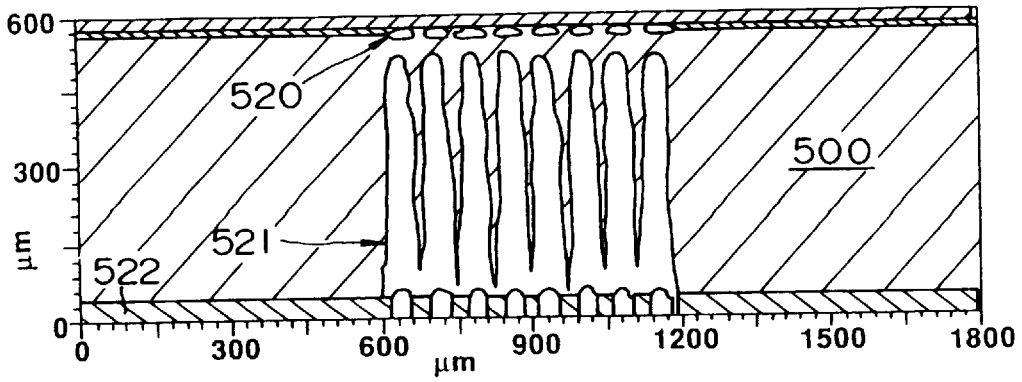

FIG. 38: Nozzle channels 521 are etched from the reverse side of the wafer 500 by an anisotropic ion enhanced etching. The channels 521 are about 50 microns in diameter, and about 500 microns deep. The depth of the channels 521 is such that the distance between the top of the channel and the bottom of the thermal chamber 520 is the required nozzle length. The etching place through a layer of resist 522.

Figure 39:
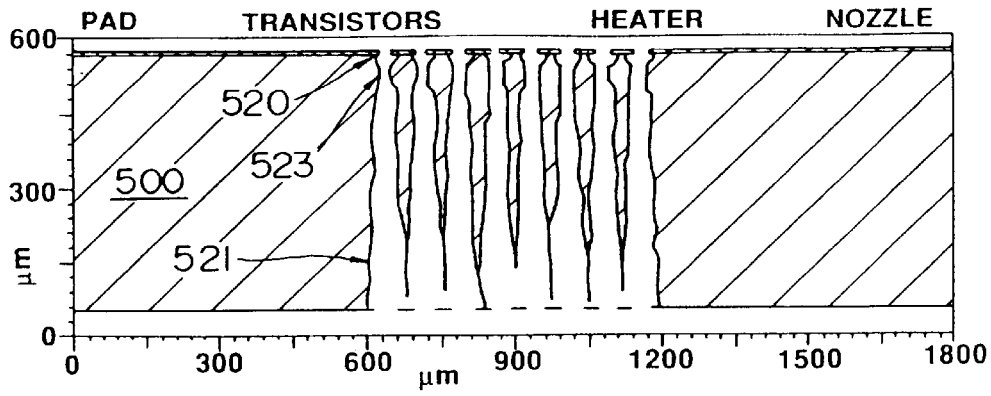

FIG. 39: The nozzle via is etched from the front side of the wafer 500 using a highly an anisotropic ion enhanced etching. This etch is from the bottom of the thermal chamber 520 to the top of the back etched nozzle channels 521, and is about 20 microns in length, and 20 microns in diameter. The nozzle barrels 523 are formed therefrom.

Figure 40:
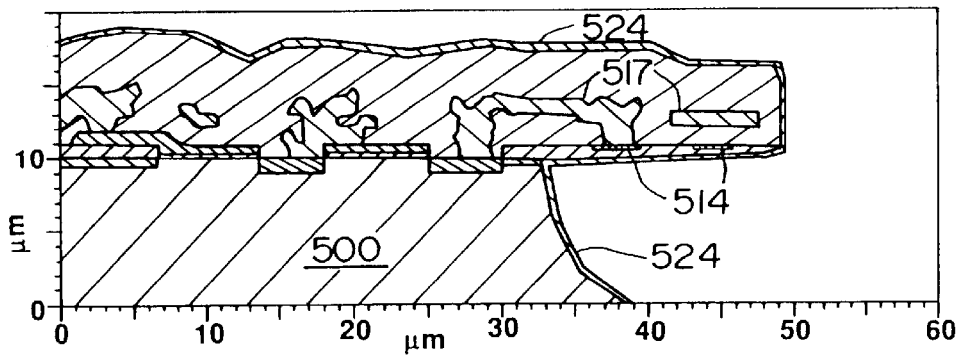

FIG. 40: A 0.5 micron passivation layer 524 of tantalum is conformably coated over the entire wafer 500.

Figure 41:
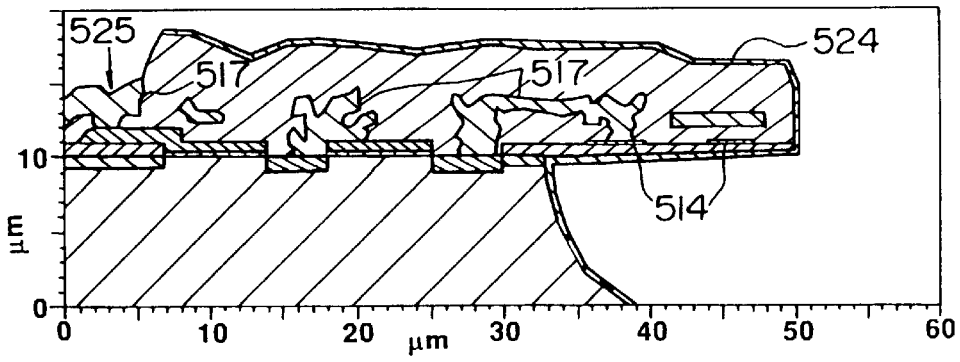

FIG. 41: in this step, windows are open for the bonding pads 524. This requires a resist coating, exposure to a twelfth level mask, resist development, etching of the tantalum passivation layer 524, ion enhance etching of the overcoat 518, and resist striping. As 2 microns of aluminum is available in the pad regions, it is easy to avoid etching through the pads formed by the second level metal 517.

Figure 42:
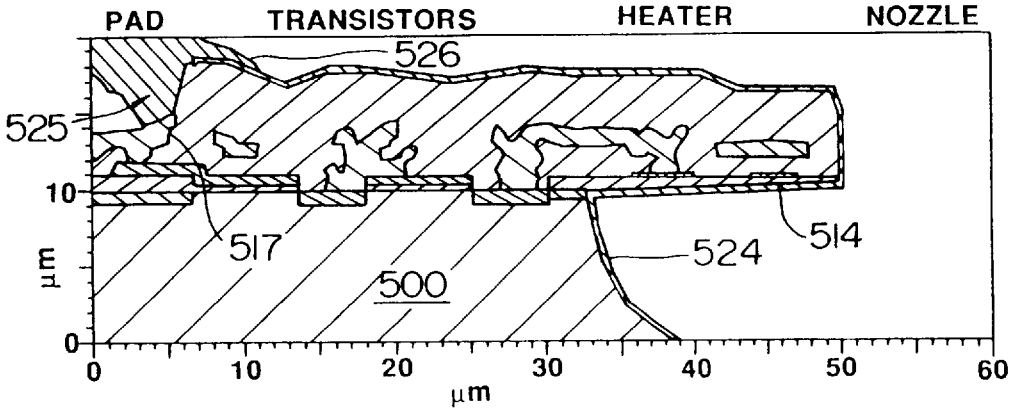

FIG. 42: After probing of the wafer 500, the ZBJ chip is mounted into a frame or support extrusion as earlier described and glued into place. Wires 526 are bonded to the pads formed by the second level metal 525 at the ends of the chip. Power rails are bonded along the two long edges of the chip. Connections are then potted in epoxy resin.

Figure 43:
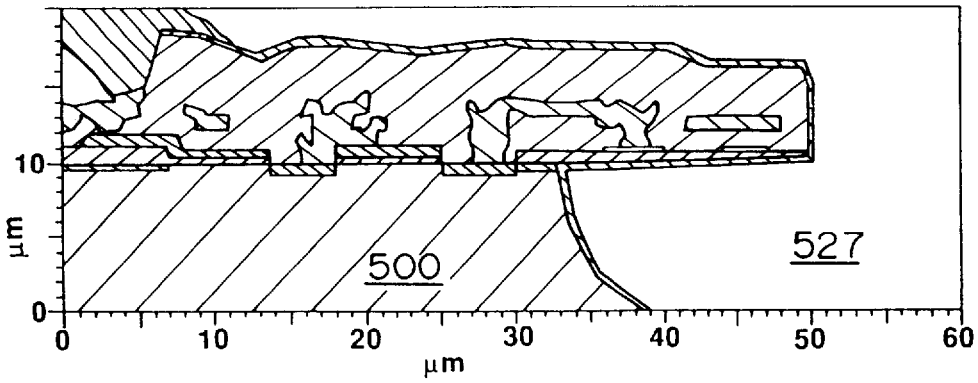

FIG. 43: This shows a forward ejection type ZBJ nozzle filled with ink 527. In this case, the droplet is ejected downwards when the nozzle fires. This type of head requires priming of ink using positive pressure, as it will not be filled by capillary action. A similar head construction can be used for reverse firing nozzles by filling the head heat chip from the other side.

While the foregoing description represents a fabrication process for a general, preferred nozzle structure, similar steps, although with some differences, used other nozzle structures. Each of the following processes is a 2 micron NMOS with two level metal process as this is the simplest process which can be used to produce high resolution, high performance colour ZBJ devices. Also, the consistency between the processes permits an easier comparison therebetween.

A summary of the process steps required to provide such a structure is as follows:

1) starting water: p type, 600 microns thick;
2) grow 0.15 microns silicon nitride;
3) pattern nitride using mask 1;
4) implant field;
5) grow 0.8 micron field oxide;
6) implant depletion arsenic using mask 2;
7) grow 0.1 micron gate oxide;
8) deposit polysilicon (1 micron);
9) pattern polysilicon using mask 3;
10) etch diffusion windows;
11) diffuse n+regions;
12) deposit 1 micron CVD glass;
13) pattern contacts using mask 4;
14) deposit 0.05 micron hafnium boride heater;
15) etch heater using mask 5;
16) deposit first metal (1 micron);
17) pattern metal using mask 6;
18) deposit 1 micron CVD glass;
19) pattern contacts using mask 7;
20) deposit second metal (including thermal shunt), 1 micron aluminum;
21) pattern metal using mask 8;
22) deposit 10 microns CVD glass;
23) etch nozzle through CVD glass using mask 9;
24) etch thermal chamber using isotropic etch;
25) back-etch barrels through the wafer using ask 10;
26) join thermal chambers to barrels using an anisotropic, unmasked etch;
27) deposit 0.5 micron tantalum passivation;
28) open pads using mask 11;
29) wafer probe;
30) mount into head assembly;
31) bond wire;
32) pot in epoxy;
33) fill with ink. Head will fill by capillarity.

A summary of the process steps requires to provide another such structure is as follows:

1) starting wafer: p type, 600 microns thick;
2) grow 0.15 microns silicon nitride
3) pattern nitride using mask 1;
4) implant field;
5) grow 0.8 micron field oxide;
6) implant depletion arsenic using mask 2;
7) grow 0.1 micron gate oxide;
8) deposit polysilicon (1 micron);
9) pattern polysilicon using mask 3;
10) etch diffusion windows;
11) diffuse n+ regions;
12) deposit 1 micron CVD glass;
13) pattern contacts using mask 4;
14) deposit 0.05 micron $HfB_2$ heater;
15) etch heater using mask 5;
16) deposit first metal (1 micron);
17) pattern metal using mask 6;
18) deposit 1 micron CVD glass;
19) pattern contacts using mask 7;
20) deposit second metal (including thermal diffuser), 1 micron aluminum;
21) pattern metal using mask 8;
22) deposit 3 microns CVD glass;
23) etch entrance to thermal chamber through CVD glass using mask 9;
24) etch thermal chamber using isotropic plasma etch;
25) etch holes 520 microns deep, 80 microns wide from the back side of the wafer, using mask 10;
26) join thermal chambers to barrels using an anisotropic RIE using thermal chamber entrance as a mask;
27) deposit 0.5 micron tantalum passivation;
28) pen pads using mask 11;
29) wafer probe;
30) bond wires;
31) pot in epoxy
32) mount into head assembly;
33) fill head assembly with ink;
34) prime head with positive ink pressure above the bubble pressure of the nozzle.

A summary of the process steps required to provide another structure is as follows:

1) starting wafer: p type, 600 microns thick;
2) grow 0.15 microns silicon nitride;
3) pattern nitride using mask 1;
4) implant field;
5) etch a circular trench around the nozzle position, 22 microns diameter, 2 microns deep, 1 micron wide using mask 2;
6) grow 0.4 micron field oxide (this also grown on the trench walls);
7) deposit 0.05 micron $HfB_2$ heater;
8) etch heater using mask 3;
9) implant arsenic using mask 4;
10) grow 0.1 micron gate oxide;
11) deposit polysilicon (1 micron);
12) pattern polysilicon using mask 5;
13) etch diffusion windows;
14) diffuse n+ regions;
15) deposit 1 micron CVD glass;
16) pattern contacts using mask 6;
17) deposit first metal (1 micron);
18) pattern metal using mask 7;
19) deposit 1 micron CVD glass;
20) pattern contacts using mask 8;
21) deposit second metal, 1 micron aluminum;

22) pattern metal using mask 9;

23) deposit 20 microns CVD glass, forming the nozzle layer;

24) anisotropically etch thermal chamber and nozzle using mask 10 (undersized diameter of less than 18 microns);

25) etch holes 520 microns deep, 80 microns wide from the back side of the wafer, using mask 11. Join to nozzles.

26) use a silicon specific isotropic "wash" etch to enlarge the thermal chamber to the edge of to the heater trench;

27) deposit 0.5 micron tantalum passivation;

28) open pads using mask 12;

29) wafer probe;

30) bond wires;

31) pot in epoxy;

32) mount into head assembly;

33) fill head assembly with ink.

A summary of the process steps required to provide still another such structure is as follows:

1) starting wafer: p type, 600 microns thick;

2) grow 0.15 microns silicon nitride;

3) pattern nitride using mask 1;

4) implant field;

5) etch a circular trench around the nozzle position. 22 microns diameter, 2 microns deep, 1 micron wide using mask 2;

6) grow 0.4 micron field oxide (this also grows on the trench walls);

7) deposit 0.05 micron $HfB_2$ heater;

8) etch heater using mask 3;

9) implant arsenic using mask 4;

10) grow 0.1 micron gate oxide;

11) deposit polysilicon (1 micron);

12) pattern polysilicon using mask 5;

13) etch diffusion windows;

14) diffuse n+ regions;

15) deposit 1 micron CVD glass;

16) pattern contacts using mask 6;

17) deposit first metal (1 micron);

18) pattern metal using mask 7;

19) deposit 1 micron CVD glass;

20) pattern contacts using mask 8;

21) deposit second metal (including thermal diffuser), 1 micron aluminum;

22) pattern metal using mask 9;

23) deposit 3 microns CVD glass;

24) anisotropically etch thermal chamber and nozzle using mask 10 (undersized diameter of less than 18 microns to avoid etching heaters);

25) etch holes 520 microns deep, 80 microns wide from the back side of the wafer, using mask 11. Join to nozzles.

26) use a silicon specific isotropic "wash" etch to enlarge the thermal chamber to the edge of to the heater trench;

27) deposit 0.5 micron tantalum passivation;

28) open pads using mask 12;

29) wafer probe;

30) bond wires;

31) pot in epoxy;

32) mount into head assembly;

33) fill head assembly with ink.

A summary of the process steps required to provide a further such structure is as follows:

1) startling wafer: p type, 600 microns thick;

2) grow 0.15 microns silicon nitride;

3) pattern nitride using mask 1;

4) implant field;

5) grow 0.7 micron gate oxide;

6) implant arsenic using mask 2;

7) grown 0.1 micron gate oxide;

8) deposit polysilicon (1 micron);

9) pattern polysilicon using mask 3;

10) etch diffusion windows;

11) diffuse n+ regions;

12) etch a 2 micron deep circular depression slightly wider than the nozzle diameter using mask 4;

13) deposit 1 micron CVD glass;

14) pattern contacts using mask 5;

15) deposit 0.05 micron $HfB_2$ heater;

16) etch heater anisotropically (in the vertical direction only) using mask 6;

17) deposit first metal (1 micron);

18) pattern metal using mask 7;

19) deposit 1 micron CVD glass. This provides inter-level dielectric, as well as covering the heater.

20) pattern contacts using mask 8;

21) deposit second metal (including thermal diffuser), 1 micron aluminum;

22) pattern metal using mask 9;

23) deposit 20 microns CVD glass;

24) anisotropically etch nozzle into CVD glass using mask 10;

25) etch the silicon thermal chamber anisotropically using an ion assisted plasma etch specific for silicon, using CVD glass hole as a mask;

26) etch holes 520 microns deep, 80 microns wide from the back side of the wafer, using mask 11. Join to thermal chambers;

27) deposit 0.5 micron tantalum passivation;

28) open pads using mask 12;

29) wafer probe;

30) bond wires;

31) pot in epoxy;

32) mount into head assembly;

33) fill head assembly with ink.

A summary of the process steps required to provide another such structure is as follows:

1) startling wafer: p type, 600 microns thick;

2) grow 0.15 microns silicon nitride;

3) pattern nitride using mask 1;

4) implant field;

5) grow 0.7 micron gate oxide;

6) implant arsenic using mask 2;

7) grown 0.1 micron gate oxide;

8) deposit polysilicon (1 micron);

9) pattern polysilicon using mask 3;

10) etch diffusion windows;

11) diffuse n+ regions;

12) etch a 2 micron deep circular depression slightly wider than the nozzle diameter using mask 4;

13) deposit 1 micron CVD glass;

14) pattern contacts using mask 5;

15) deposit 0.05 micron $HfB_2$ heater;

16) etch heater anisotropically (in the vertical direction only) using mask 6;

17) deposit first metal (1 micron);

18) pattern metal using mask 7;

19) deposit 1 micron CVD glass. This provides inter-level dielectric, as well as covering the heater.

20) pattern contacts using mask 8;

21) deposit second metal (including thermal diffuser), 1 micron aluminum;

22) pattern metal using mask 9;

23) deposit 3 microns CVD glass;

24) anisotropically etch thermal chamber into CVD glass using mask 10;

25) etch the silicon thermal chamber anisotropically using an ion assisted plasma etch specific for silicon, using CVD glass nozzle as a mask;

26) etch holes 520 microns deep, 80 microns wide from the back side of the wafer, using mask 11. Join to nozzles;

27) deposit 0.5 micron tantalum passivation;

28) open pads using mask 12;

29) wafer probe;

30) bond wires;

31) pot in epoxy;

32) mount into head assembly;

33) fill head assembly with ink.

The ZBJ printhead 200 incorporating the ZBJ chip 100 is useful in a variety of printing applications either printing across the page in the traditional manner, as a scanning print head, or as a stationary full width print head. FIGS. 44 to 48 show various configurations for use of a number of ZBJ heads.

Figure 44:
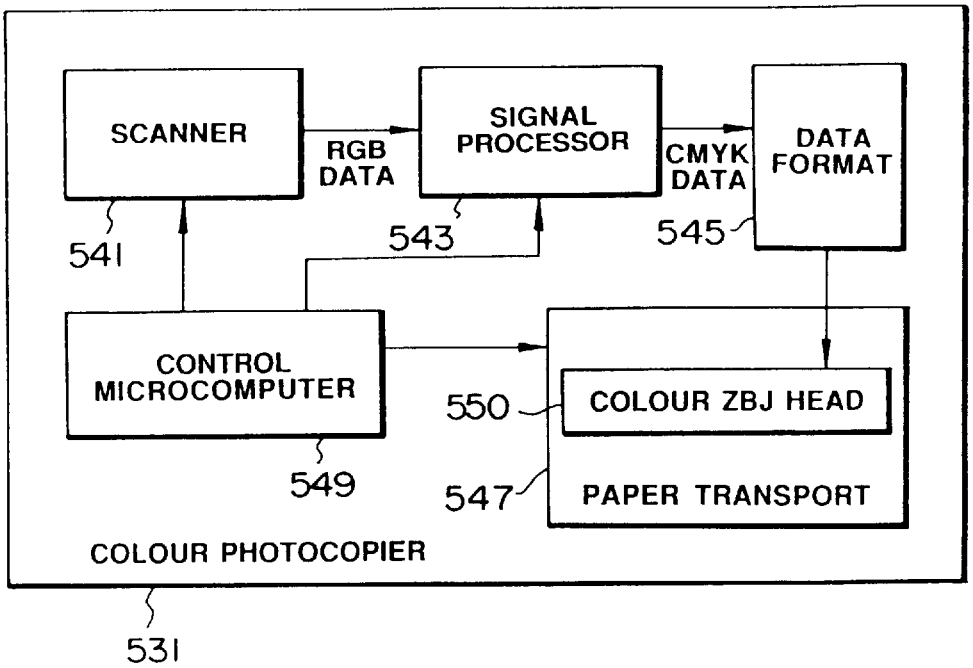
FIG. 44 is a schematic block diagram representation of a colour photo copier incorporating a colour ZBJ head.

FIG. 44 shows a colour photocopier 531 which includes a scanner 541 for scanning a page to be copied. The scanner 541 outputs red, green and blue (RGB) data to a signal processor 543 which converts the RGB data into dot screened cyan, magenta, yellow and black (CMYK) suitable for printing using the device 100. The CYMK data is input to a data formatter 545 which acts in a manner of the circuitry depicted in FIGS. 56 and 57. The data formatter 545 outputs to a full colour ZBJ head 550 capable of printing at 400 pixels per inch across an A3 page carried by a paper transport mechanism 547. A controlling microcomputer 549 co-ordinates the operation of the photocopier 531 through a sequencing control of the scanning 541, signal processor 543, and paper transport mechanism 547.

Figure 45:
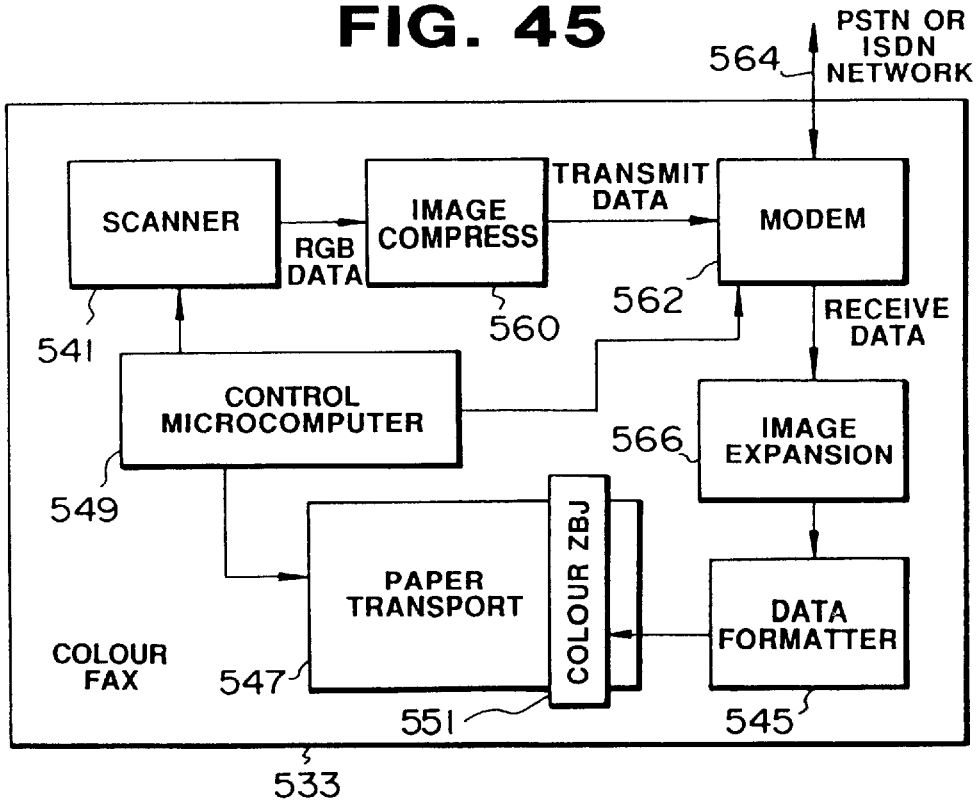
FIG. 45 is a similar representation of a colour facsimile machine.

FIG. 45 shows a colour facsimile machine 533 which includes some components designated in a similar manner to that of FIG. 44. The scanner 541 scans a page to be transmitted after which the scanned data of the image is compressed by a compressor 560. The compressor 560 can use any standard data compression system for images such as the JPEG standard. The compressor 560 outputs transmit data to a modem 562 which connects to a PSTN or ISDN network 564. The modem 562 receives data and outputs to an image expander 566, complementary to the compressor 560. The expander 566 outputs to the data formatter 545 in the manner described above. In this configuration a colour ZBJ head 551 of a size greater than the full width of the paper to be printed is used.

Figure 46:
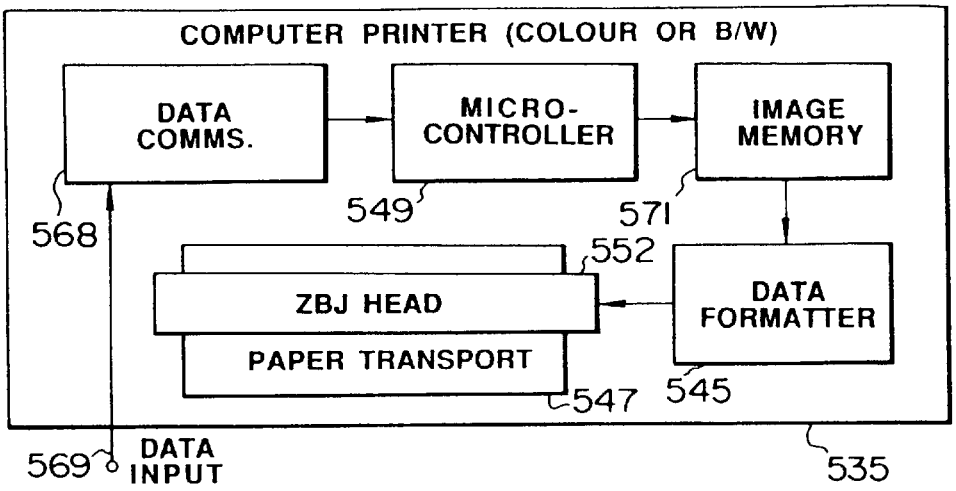
FIG. 46 is a similar representation of a printer for a computer.

FIG. 46 shows a computer printer 535 which can print either colour or black and white images depending on the type of ZBJ head used. Data is supplied via an input 569 to a data communications receiver 568. A microcontroller 549 buffers received data to an image memory 571 which outputs to a full colour data formatter in the manner described above or a simple black and white data formatter. In this embodiment the data formatter 545 outputs to a full length ZBJ head 552 for printing on paper carried by the paper transport mechanism 547.

Figure 47:
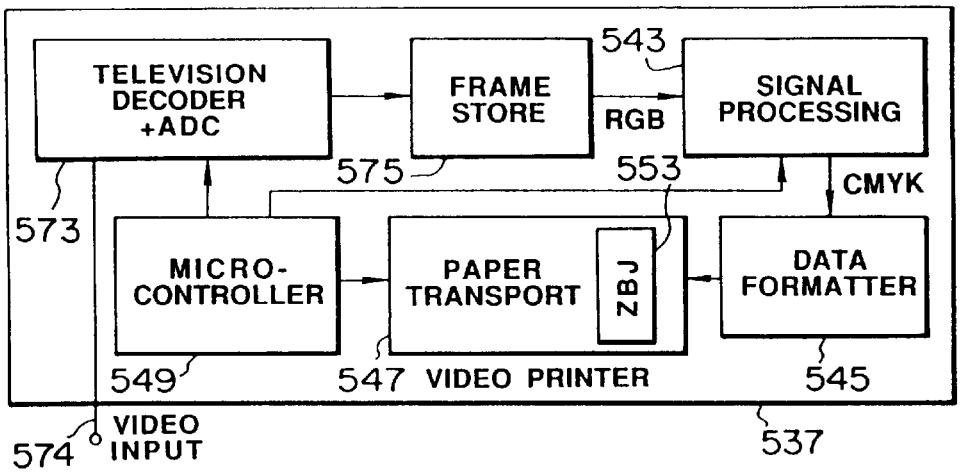
FIG. 47 is a similar representation of a video printer.

In FIG. 47 a video printer 537 is shown which accepts video data via an input 574 which is input to a television decoder and ADC unit 573 which outputs image pixel data to a frame store 575. A signal processor 543 converts RGB data to CMYK data for printing in the manner previously described. A small colour ZBJ head 553 prints on a photographed sized paper carried by the paper transport 547 for printing.

Figure 48:
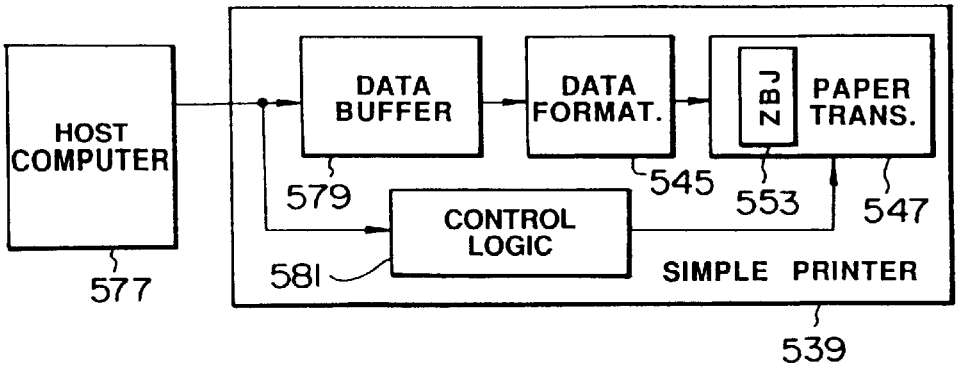
FIG. 48 is a similar representation of a simple printer.

Finally FIG. 48 shows the configuration of a simple printer 539 in which page formatting is performed in a host computer 577. The computer 577 outputs data and control information to a buffer 579 which outputs to the data formatter 545 in the manner described above. A simple control logic unit 581 also receives commands from the host computer 577 for control of the paper transport mechanism 547.

Furthermore, those skilled in the art will realize that any combination of ZBJ heads can be used in any of the above embodiments. For example, multi-head redundancy as previously described can be used in both page printing and scanning heads. For ultra-high resolution (1600 dpi) monochrome printing can be used in any embodiment.

The foregoing description only describes a number of embodiments of the present invention and modifications, obvious to those skilled in the art can be made thereto without departing from the scope of the present invention.

TABLE 1

| Application/ Feature | 1. Scanning Contone colour ZBJ Head | 2. Scanning Grey Tone ZBJ Head | 3. Photo Size Contone Color ZBJ Head | 4. Full Width A4 Contone Color ZBJ Head |
|---|---|---|---|---|
| Chip size (mm) | 10 × 4 | 10 × 1.5 | 100 × 2 | 220 × 4 |
| No. of Nozzles | 2048 | 512 | 5120 | 51200 |
| No. of Pixels | 128 | 128 | 1280 | 3200 |
| Nozzles Per Pixel Per Color | 4 | 4 | 1 | 4 |
| No. of colours | 4 | 1 | 4 | 4 |
| Print Speed | 3 mins (A4) | 3 mins (A4) | 8 sec (photo) | 3.7 sec (A4) |
| Tone | | FULL GREY SCALE | | |
| Resolution (pixel/inch) | 400 | 400 | 400 | 400 |

| Application/ Feature | 5. Fill Width A4 Bilevel ZBJ Head | 6. High Speed A3 Contone colour ZBJ Head | 7. Medium Speed A3 Contone colour ZBJ Head |
|---|---|---|---|
| Chip size (mm) | 220 × 2 | 310 × 4 | 310 × 2 |

TABLE 1-continued

| | | | |
|---|---|---|---|
| No. of Nozzles | 12800 | 71680 | 17920 |
| No. of Pixels | 12800 | 4480 | 4480 |
| Nozzles Per Pixel Per Color | 1 | 4 | 1 |
| No. of colours | 1 | 4 | 4 |
| Print Speed | 3.7 sec (A4) | 5.3 sec (A3) | 21 sec (A3) |
| Tone | | FULL GREY SCALE | |
| Resolution (pixel/inch) | 1600 | 400 | 400 |

TABLE 2

| Fault | Consequence |
|---|---|
| Main drive track open | Main heater fails, redundant heater takes over. |
| Redundant drive track open | Redundant heater fails: no effect. |
| V + track open | Block of 32 heaters fail, redundant heaters take over. |
| Ground open | Block of 32 redundant heaters fail: no effect. |
| Two main drive tracks shorted | Both nozzles will fire. |
| Two redundant drive tracks shorted | No effect. |
| Main drive track shorted to redundant drive tack | Both heaters will be in series between v + and ground, and constantly on at half power. Either the main heater or the redundant heater will overheat and go open circuit (under normal conditions, average power is 1/32 of pulse power). The other heater will take over. |
| Main drive track shorted to V+ | Drive transistor will fuse when turned on. Redundant circuit takes over. |
| Main drive track shorted to ground | Main heater will overheat as it is constantly on. It will go open circuit. The redundant circuit will take over. |
| Redundant drive track shorted to V+ | Redundant heater will overheat as it is constantly on. It will go open circuit. No effect. |
| Redundant drive track shorted to ground | Redundant transistor will fuse if ever turned on. No effect if main circuit works. |
| V + shorted to ground | short, V + track or Ground track will fuse. If V+ track fuses, redundant circuits will take over from isolated main circuits. Other conditions have no effect. |
| Sense track open | Redundant circuit will not operate: no effect. |
| Other conditions of sense track | Same as for main drive |

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

I claim:

1. A monolithic ink jet head in which a plurality of nozzles are arranged in two directions for printing a multi-tone image by forming a plurality of pixels at a pixel ditch on a recording medium, each of the pixels having a gradation corresponding to a number of droplets of an ink of a same color deposited, comprising:

a monolithic substrate; and a plurality of nozzles for ejecting the droplets of the same color provided on said monolithic substrate for ejecting the ink, said plurality of nozzles being arranged on said monolithic substrate in an arranging direction and a transverse direction which is transverse to said arranging direction such that a shortest distance between said nozzles which are adjacent, is shorter in at least one of said arranging direction and said transverse direction than the pixel pitch, and a shortest distance between said nozzles which are adjacent in an other of said arranging direction and said transverse direction which is not the one of said arranging direction and said transverse direction is not substantially longer than the pixel pitch.

2. An ink jet head according to claim 1, wherein the shortest distance between said nozzles which are adjacent in the other of said arranging direction and said transverse direction which is not the one of said arranging direction and said transverse direction is not shorter than the pixel pitch.

3. An ink jet head according to claim 1, wherein the shortest distance between said nozzles which are adjacent in the other of said arranging direction and said transverse direction which is not the one of said arranging direction and said transverse direction is not shorter than 1.25 times the pixel pitch.

4. An ink jet head according to claim 1, wherein the shortest distance between said nozzles which are adjacent in the other of said arranging direction and said transverse direction which is not the one of said arranging direction and said transverse direction is substantially equal to the pixel pitch.

5. An ink jet head according to claim 4, wherein the shortest distance between said nozzles which are adjacent in the other of said arranging direction and said transverse direction which is not the one of said arranging direction and said transverse direction is substantially equal to a sum of the pixel pitch and a distance corresponding to an ejecting order of said nozzles.

6. An ink jet head according to claim 1, wherein a number of said nozzles per one said pixel in at least one of said arranging direction and said transverse direction is m, wherein $m \leqq 4$.

7. An ink jet head according to claim 1, wherein a number of said nozzles per one said pixel in at least one of said arranging direction and said transverse direction equals 4.

8. An ink jet head according to claim 1, wherein a number of ejections per one said nozzle per one said pixel is k, wherein $k \leqq 4$.

9. An ink jet head according to claim 8, wherein a number of said nozzles per one said pixel in at least one of said arranging direction and said transverse direction is m, wherein $m \leqq 4$.

10. An ink jet head according to claim 8, wherein a number of said nozzles per one said pixel in at least one of said arranging direction and said transverse direction equals 4.

11. An ink jet head according to claim 1, wherein a number of ejections per one said nozzle per one said pixel equals 4.

12. An ink jet head according to claim 1, wherein said plurality of nozzles discharge a plurality of kinds of ink having different colors.

13. An ink jet head according to claim 1, wherein each of said plurality of nozzles has a heating element for generating thermal energy used for ejecting ink.

14. An ink jet head according to claim 1, wherein $0<P_X$, $P_Y$ and $P_X<P_I$ or $P_Y<P_I$, where $P_X$ represents a shortest distance in a one of said arranging direction and said transverse direction between said nozzles which are adjacent, $P_Y$ represents a shortest distance in an other of said arranging direction and said transverse direction which is not the one of said arranging direction and said transverse direction between said nozzles which are adjacent, and $P_I$ represents the pixel pitch, and that of $P_X$ or $P_Y$ which is not less than $P_I$ is not substantially longer than $P_I$.

15. An ink jet according to claim 14, wherein $Pd>P_I$, where $Pd=\sqrt{(P_X^2+P_Y^2)}$.

16. An ink jet head according to claim 14, wherein $Pd\geqq 1.25\ P_I$, where $Pd=\sqrt{(P_X^2+P_Y^2)}$.

17. An ink jet head according to claim 14, wherein $P_Y\approx P_I$ or $P_X\approx P_I$.

18. An ink jet head according to claim 17, wherein $P_Y=P_I+P_{CN}$ or $P_X=P_I+P_{CN}$, where $P_{CN}$ represents a compensation distance for a given said nozzle having an ejecting order N.

19. An ink jet head according to claim 14, wherein $P_X=(m-1)/m\cdot P_I$ or $P_Y=(m-1)/m\cdot P_I$, where m represents a number of said nozzles per one said pixel.

20. An ink jet head according to claim 19, wherein m=4.

21. An ink jet head according to claim 19, wherein $P_Y=P_I$ or $P_X=P_I$.

22. An ink jet head according to claim 21, wherein m=4.

23. An ink jet head according to claim 22, wherein a number of ejections per one said nozzle per one said pixel is k, wherein $k\leqq 4$.

24. An ink jet head according to claim 22, wherein a number of ejections per one said nozzle per one said pixel equals 4.

25. A method for printing on a printing medium by using a monolithic ink jet head in which a plurality of nozzles are arranged in two directions for printing a multi-tone image by a forming a plurality of pixels at a pixel pitch on the printing medium, each of the Pixels having a gradation corresponding to a number of droplets of an ink of a same color deposited, said method comprising the steps of:

providing said ink jet head having:

(i) a substrate, and (ii) a plurality of nozzles for ejecting the droplets of the same color provided on the monolithic substrate for ejecting the ink, the plurality of nozzles being arranged on said monolithic substrate in an arranging direction and a transverse direction which is transverse to said arranging direction such that a shortest distance in at least one of said arranging direction and said transverse direction between said nozzles which are adjacent is shorter than the pixel pitch, and a shortest distance between said nozzles which are adjacent in an other of said arranging direction and said transverse direction which is not the one of said arranging direction and said transverse direction is not substantially longer than the pixel pitch;

ejecting the ink sequentially from each of the nozzles by time share driving the nozzles; and moving the printing medium and the ink jet head relative to each other during said ejecting step.

26. A method according to claim 25, wherein the shortest distance between adjacent nozzles in the other dimension is substantially equal to a sum of the pixel pitch and a distance corresponding to an ejecting order of the plurality of nozzles.

27. A method according to claim 25, wherein during said ejecting step, ink is ejected from the plurality of nozzles sequentially but ink is not ejected sequentially from two neighboring nozzles.

28. A method according to claim 25, wherein the plurality of nozzles discharge a plurality of kinds of ink having different colors.

29. A method according to claim 25, wherein each of the plurality of nozzles has a heating element for generating thermal energy used for ejecting ink.

30. A method for printing on a printing medium according to claim 14, wherein said arranging direction is perpendicular to said transverse direction, and wherein $0<P_X$, $P_Y$ and $P_X<P_I$ or $P_Y<P_I$, where, $P_X$ represents a shortest distance between adjacent said nozzles in a one of said arranging direction and said transverse direction, $P_Y$ represents a shortest distance in an other of said arranging direction and said transverse direction which is not the one of said arranging direction and said transverse direction between said nozzles which are adjacent, and $P_I$ represents the pixel pitch, and that of $P_X$ or $P_Y$ which is not less than $P_I$ is not substantially longer than $P_I$.

31. A method according to claim 30, wherein $P_Y=P_I+P_{CN}$ or $P_X=P_I+P_{CN}$, where $P_{CN}$ represents a compensation distance for a given said nozzle having an ejecting order N.

* * * * *

UNITED STATES PATENT AND TRADEMARK OFFICE

CERTIFICATE OF CORRECTION

PATENT NO. : 5,815,173

DATED : September 29, 1998

INVENTOR(S) : KIA SILVERBROOK

It is certified that error appears in the above-identified patent and that said Letters Patent is hereby corrected as shown below:

COLUMN 2

Line 13, "two-dimensions" should read --two dimensions--.

COLUMN 7

Line 11, "2. applying" should read --2. Applying--.

COLUMN 18

Line 61, "makes" should read --masks--.

COLUMN 24

Line 14, "grown" should read --grow.--

COLUMN 28

Line 22, "an other" should read --another--.

UNITED STATES PATENT AND TRADEMARK OFFICE

CERTIFICATE OF CORRECTION

PATENT NO. : 5,815,173

DATED : September 29, 1998

INVENTOR(S) : KIA SILVERBROOK

It is certified that error appears in the above-identified patent and that said Letters Patent is hereby corrected as shown below:

COLUMN 29

Line 15, "an other" should read --another--.
Line 21, "jet" should read --jet head--.

COLUMN 30

Line 11, "an other" should read --another--.
Line 42, "an" should read --another--.
Line 43, "other" should be deleted.

Signed and Sealed this

Seventeenth Day of August, 1999

*Attest:*

Q. TODD DICKINSON

*Attesting Officer*

*Acting Commissioner of Patents and Trademarks*